US009857761B2

(12) United States Patent
Osawa et al.

(10) Patent No.: US 9,857,761 B2
(45) Date of Patent: Jan. 2, 2018

(54) IMAGE FORMING APPARATUS HAVING A SUPPORTING MEMBER FOR DISMOUNTABLY SUPPORTING ONE OR MORE CARTRIDGES

(71) Applicant: CANON KABUSHIKI KAISHA, Tokyo (JP)

(72) Inventors: Yuichiro Osawa, Kamakura (JP); Masatoshi Yamashita, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/165,556

(22) Filed: May 26, 2016

(65) Prior Publication Data

US 2016/0349698 A1 Dec. 1, 2016

(30) Foreign Application Priority Data

May 27, 2015 (JP) ..... 2015-106959

(51) Int. Cl.
*G03G 21/16* (2006.01)

(52) U.S. Cl.
CPC ... *G03G 21/1661* (2013.01); *G03G 2221/169* (2013.01)

(58) Field of Classification Search
CPC ..... G03G 21/1661; G03G 21/1807; G03G 2221/1603; G03G 2221/169; G03G 2221/1869
USPC ..... 399/110, 111, 112
See application file for complete search history.

(56) References Cited

U.S. PATENT DOCUMENTS

| | | | |
|---|---|---|---|
| 7,529,505 | B2 | 5/2009 | Okamoto |
| 7,706,720 | B2 | 4/2010 | Okamoto |
| 7,761,024 | B2 | 7/2010 | Imaizumi et al. |
| 7,907,866 | B2 | 3/2011 | Imaizumi et al. |
| 8,131,181 | B2 | 3/2012 | Hoashi |
| 8,175,487 | B2 | 5/2012 | Imaizumi et al. |
| 8,437,660 | B2 | 5/2013 | Hoashi |
| 8,442,412 | B2 | 5/2013 | Imaizumi et al. |
| 8,862,014 | B2 | 10/2014 | Imaizumi et al. |
| 9,002,230 | B2 | 4/2015 | Imaizumi et al. |
| 9,037,036 | B2 | 5/2015 | Yamashita et al. |
| 9,304,487 | B2 | 4/2016 | Shuhama et al. |

(Continued)

FOREIGN PATENT DOCUMENTS

| | | |
|---|---|---|
| JP | 2003-266865 A | 9/2003 |
| JP | 2006-259148 A | 9/2006 |

(Continued)

*Primary Examiner* — Sophia S Chen
(74) *Attorney, Agent, or Firm* — Fitzpatrick, Cella, Harper & Scinto

(57) ABSTRACT

An image forming apparatus includes a main assembly having an opening; a supporting member for dismountably supporting a cartridge for forming an image on a recording material, the supporting member being movable between an inside position and an outside position through the opening; an openable member configured to open and close the opening; and a connecting member configured to connect the openable member and the main assembly with each other, the connecting member being provided with a movement regulating portion configured to regulate movement of the supporting member placed in the outside position in a state that the openable member opens the opening.

25 Claims, 16 Drawing Sheets

(56) References Cited

U.S. PATENT DOCUMENTS

| | | | | |
|---|---|---|---|---|
| 2008/0159781 | A1* | 7/2008 | Noguchi | G03G 21/1623 399/110 |
| 2010/0080617 | A1* | 4/2010 | Noguchi | G03G 21/1853 399/112 |
| 2011/0026968 | A1* | 2/2011 | Ishii | G03G 21/1671 399/111 |
| 2012/0183323 | A1* | 7/2012 | Nakano | G03G 15/0194 399/110 |
| 2014/0147158 | A1* | 5/2014 | Fujinaka | G03G 21/1661 399/110 X |
| 2015/0037067 | A1* | 2/2015 | Sato | G03G 21/1633 399/111 |
| 2015/0055976 | A1* | 2/2015 | Murakami | G03G 21/1661 399/110 |
| 2016/0085206 | A1* | 3/2016 | Iizuka | G03G 21/1623 399/111 |

FOREIGN PATENT DOCUMENTS

| | | | |
|---|---|---|---|
| JP | 2007-213018 | A | 8/2007 |
| JP | 2009-003413 | A | 1/2009 |
| JP | 2010-122661 | A | 6/2010 |
| JP | 2013-246366 | A | 12/2013 |

* cited by examiner

IMAGE FORMING APPARATUS HAVING A SUPPORTING MEMBER FOR DISMOUNTABLY SUPPORTING ONE OR MORE CARTRIDGES

FIELD OF THE INVENTION AND RELATED ART

The present invention relates to an image forming apparatus which forms an image on recording medium with the use of an electrophotographic method, for example, and in which a cartridge, which is an expendable cartridge, is removably installable. An image forming apparatus includes a copying machine, a printing machine (such as a laser beam printer, an LED printer, and the like), a facsimileing machine, a word processor, and the like.

An image forming apparatus (electrophotographic image forming apparatus) such as a printer which uses an electrophotographic process uniformly charges its photosensitive component, which is an image bearing component. Then, it forms a latent image on the photosensitive component by selectively exposing various points of the uniformly charged peripheral surface of the photosensitive component. This latent image is developed into a visible image, which is an image formed of developer (toner), with the use of developer. Then, this image formed of developer (which hereafter will be referred to simply as developer image or toner image) is transferred onto recording medium such as recording paper. Then, the developer image is fixed to the recording medium by the application of a combination of heat and pressure to the recording medium and the developer image thereon.

Some electrophotographic color image forming apparatuses are structured so that multiple cartridges are roughly horizontally aligned in the main assembly of the apparatuses. In order to make it easier to install cartridges into the main assembly of these types of image forming apparatus, or uninstall the cartridges from the main assembly, some of them are structured so that multiple cartridges can be pulled out together. There is disclosed in Japanese Laid-open Patent Application No. 2013-246366, an electrophotographic color image forming apparatus structured to make it easier for a user to replace the cartridges in the main assembly of the apparatus. According to this application, in order to ensure that cartridges can be easily, reliably, and removably installed in the main assembly of the apparatus, and also, to reduce the main assembly in size, the front wall of the main assembly is provided with a large opening, and a door which is to be opened to expose the large opening to install or uninstall cartridges.

Referring to FIG. 16, in the case of the structure disclosed in Japanese Laid-open Patent Application No. 2013-246366, the top-front portion of the main assembly of the image forming apparatus is provided with an opening 80R, and a door 31. Cartridges are replaced while the cartridge supporting component remains regulated in movement by the door 31. This structural arrangement has an issue that as the main assembly of the apparatus is reduced in size, the door is limited in shape, hinge position, and angle of opening.

For example, in a case of an image forming apparatus structured so that when its door is open, there is a substantial distance between the door and cartridge supporting component, the following situation occurs. That is, in some cases, extending the door in the direction in which the cartridge supporting component is pulled out of the main assembly, to provide the door with a regulating section for regulating the movement of the cartridge supporting component, requires the door to be increased in size.

SUMMARY OF THE INVENTION

The primary object of the present invention is to further develop a structural arrangement for an image forming apparatus, which can make it possible to regulate a cartridge supporting component in movement when the cartridge supporting component is in its outermost position relative to the main assembly.

According to an aspect of the present invention, there is provided an image forming apparatus comprising: a main assembly provided with an opening; a supporting member configured to dismountably support a cartridge configured to form a image on a recording material, said supporting member being movable between an inside position, which is inside said main assembly, and an outside position, which is outside said main assembly, through said opening; an openable member configured to open and close said opening; and a connecting member configured to connect said openable member and said main assembly with each other, said connecting member being provided with a movement regulating portion configured to regulate movement of said supporting member placed in the outside position in a state that said openable member opens said opening.

Further features of the present invention will become apparent from the following description of exemplary embodiments with reference to the attached drawings.

Figure 7:
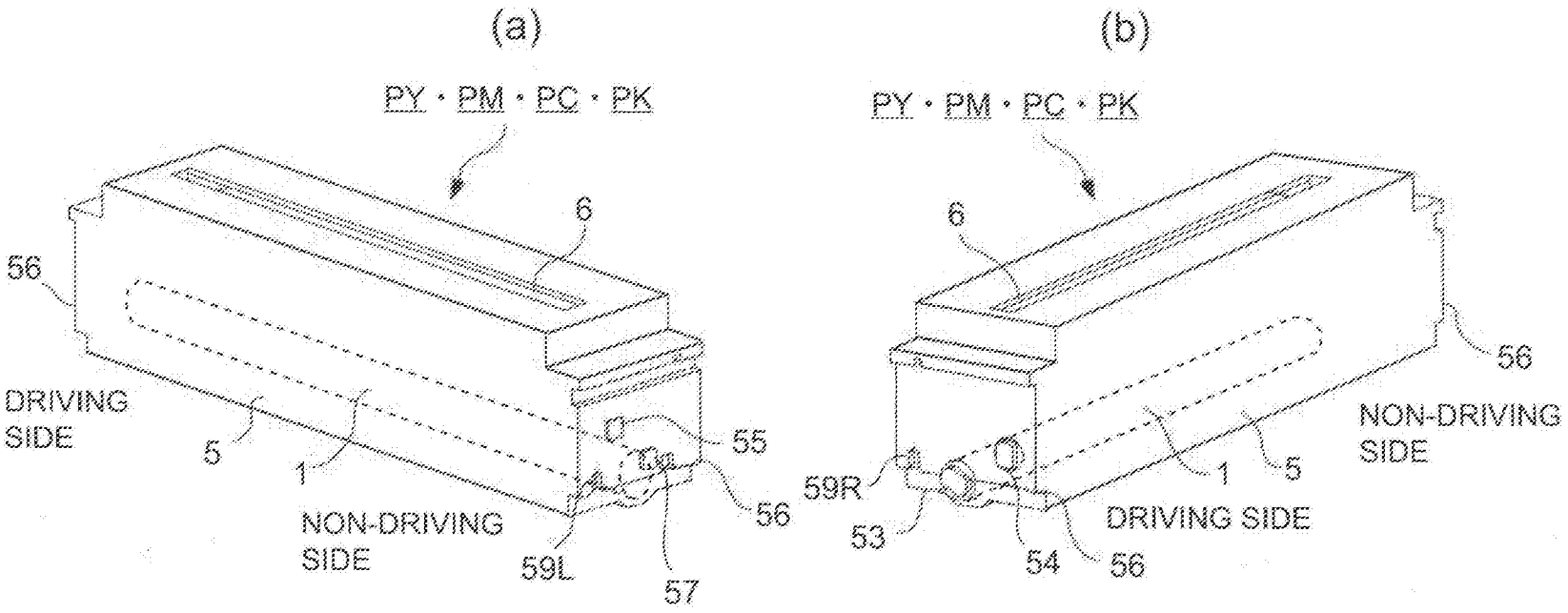

Part (a) of FIG. 7 is a perspective view of one of the cartridges as seen from the side from which it is not driven, and part (b) of FIG. 7 is a perspective view of one of the cartridges, as seen from the side from which it is driven.

Figure 8:
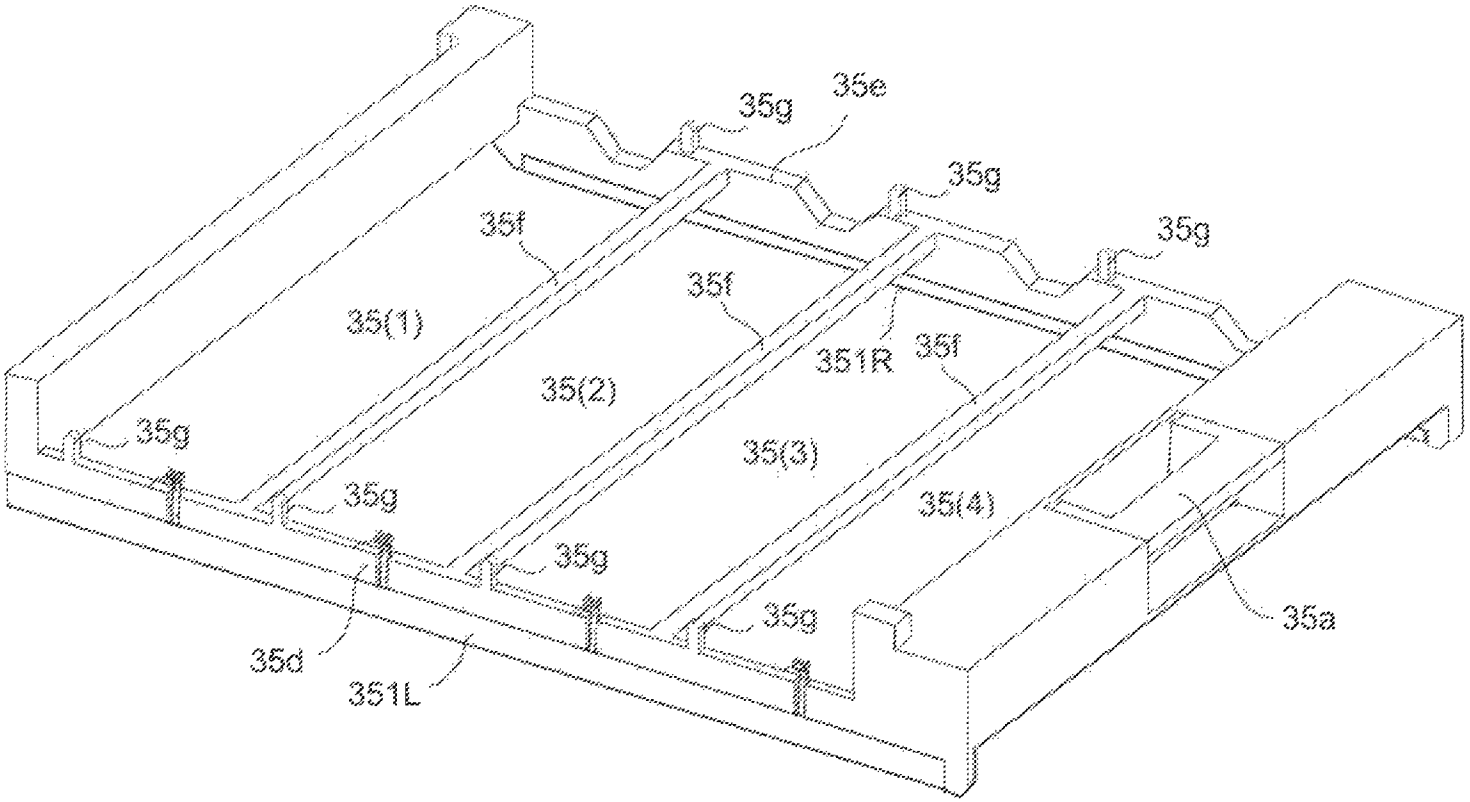

FIG. 8 is a perspective view of the cartridge tray of the main assembly of the image forming apparatus.

Figure 9:
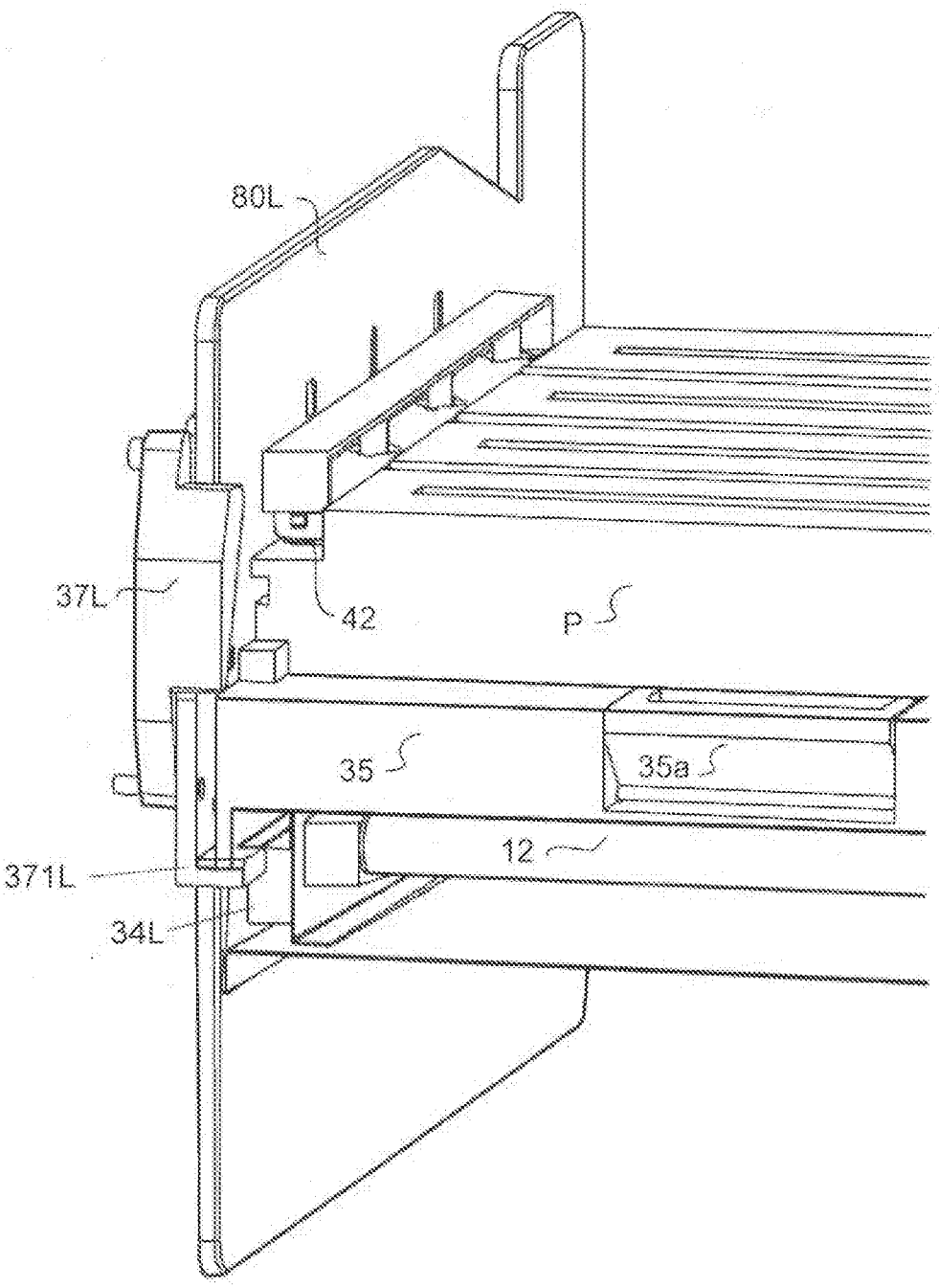

FIG. 9 is a drawing for describing the inward side of the door, as seen from the front side, when the door is closed.

Figure 10:
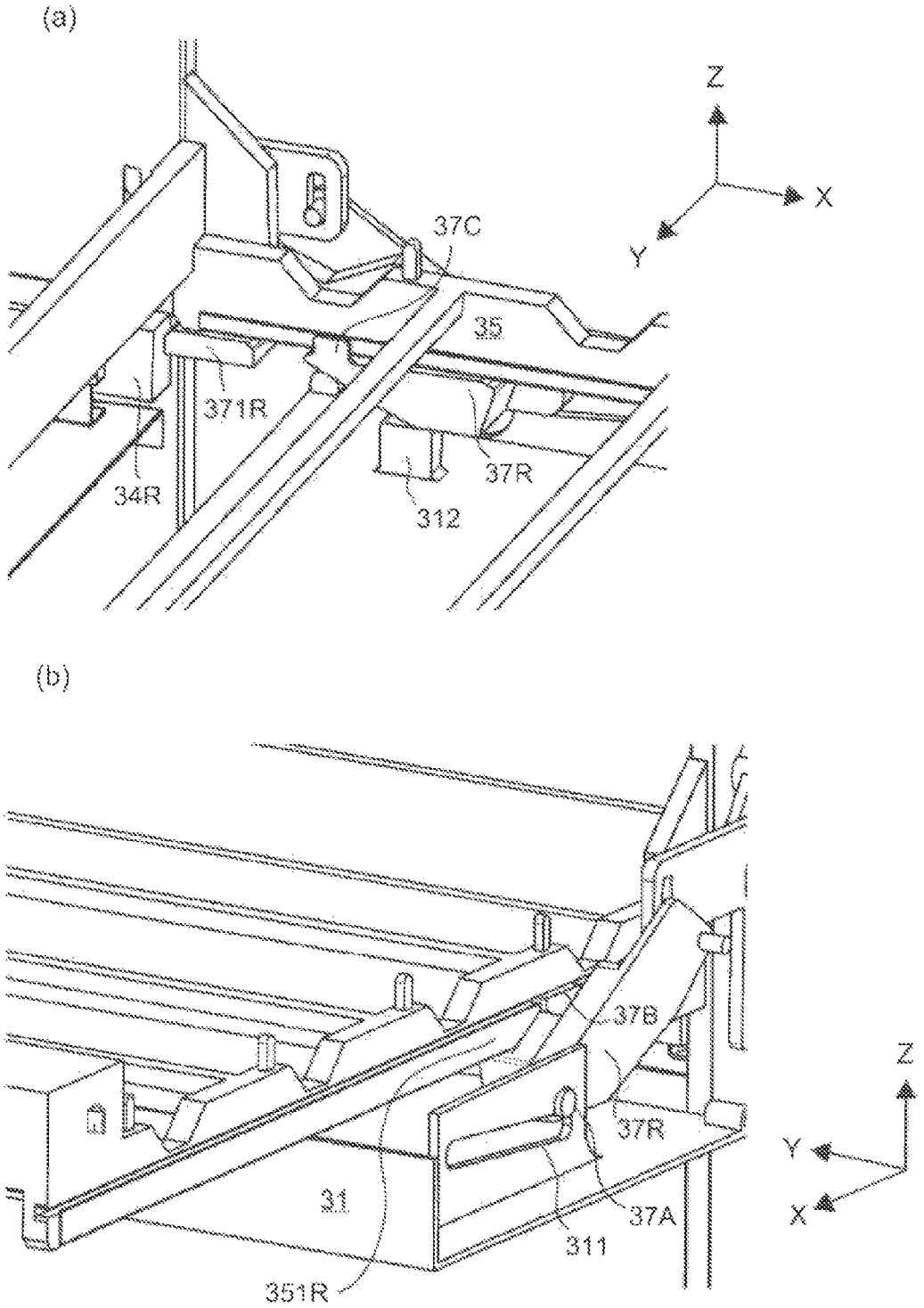

Parts (a) and (b) of FIG. 10 are the right end portion of the cartridge tray, and the components in the adjacencies of the right end portion of the tray, as seen from the inside and outside, respectively, of the main assembly, when the tray is in the outermost position relative to the main assembly.

Figure 11:
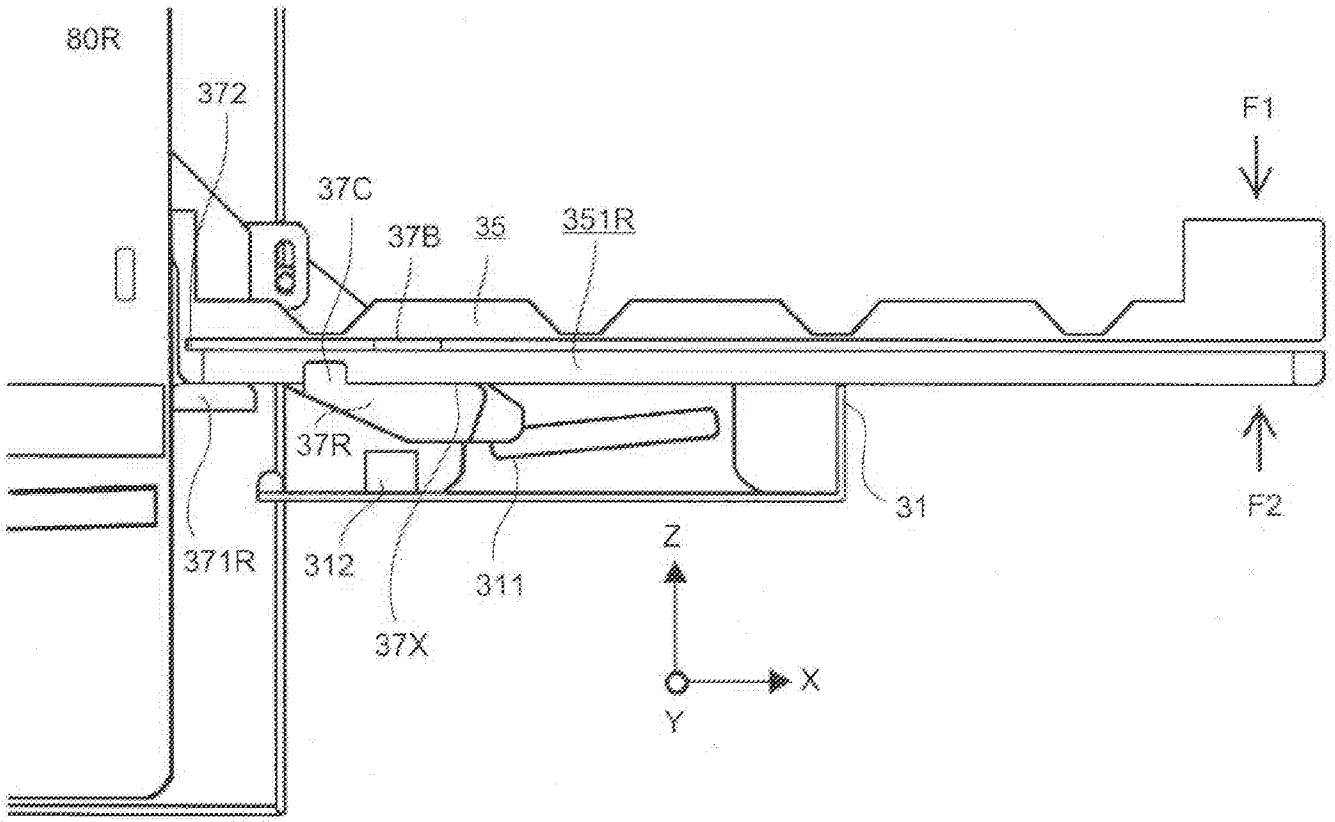

FIG. 11 is a sectional drawing for describing the state of the cartridge tray and tray supporting components when the tray is in its outermost position relative to the main assembly.

Figure 12:
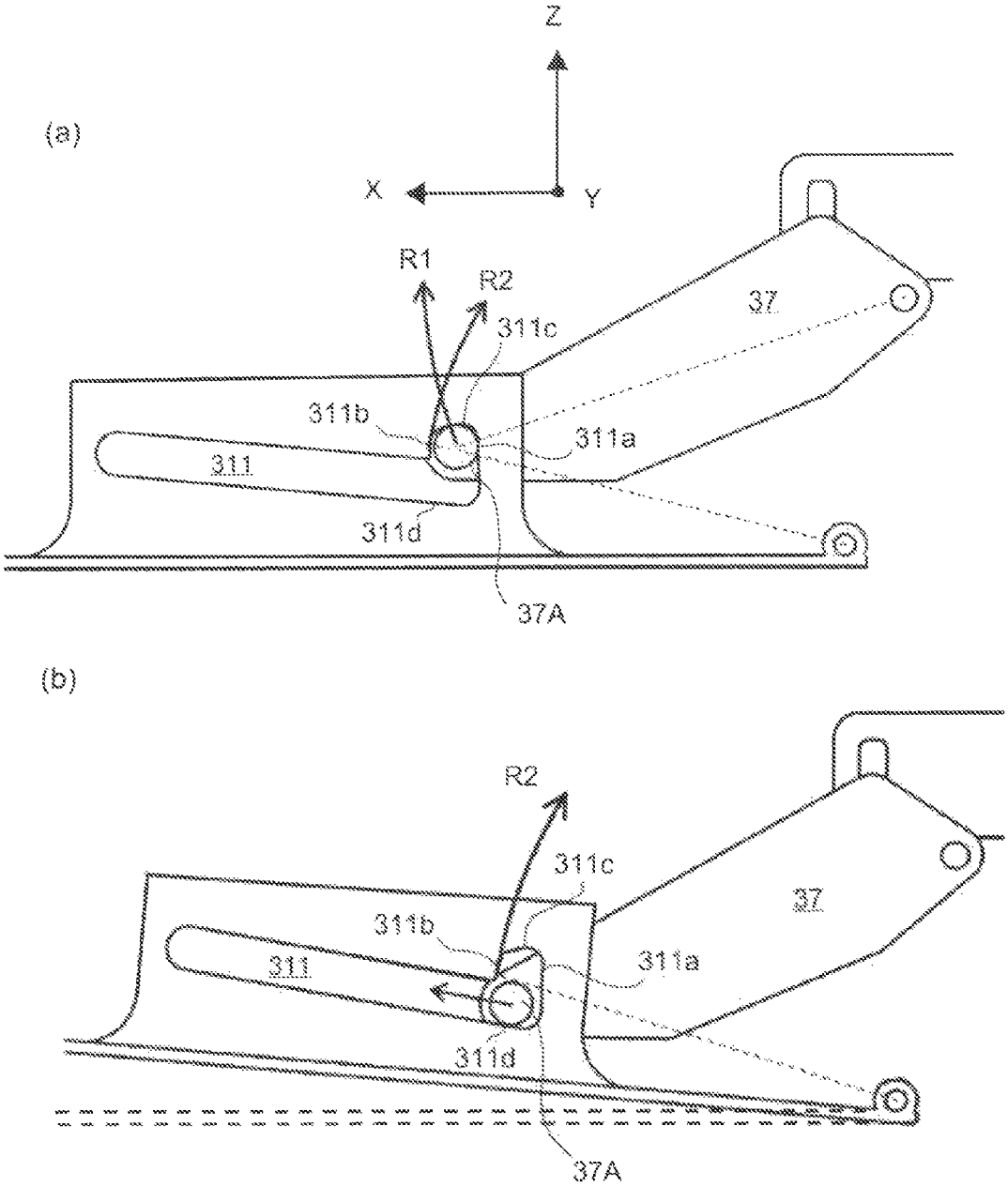

Parts (a) and (b) of FIG. 12 are drawings for describing the relationship between the slot with which the door is provided, and a connective arm which connects the main assembly to the door, when the door is fully open, and when the door is slightly closed, respectively.

Figure 13:
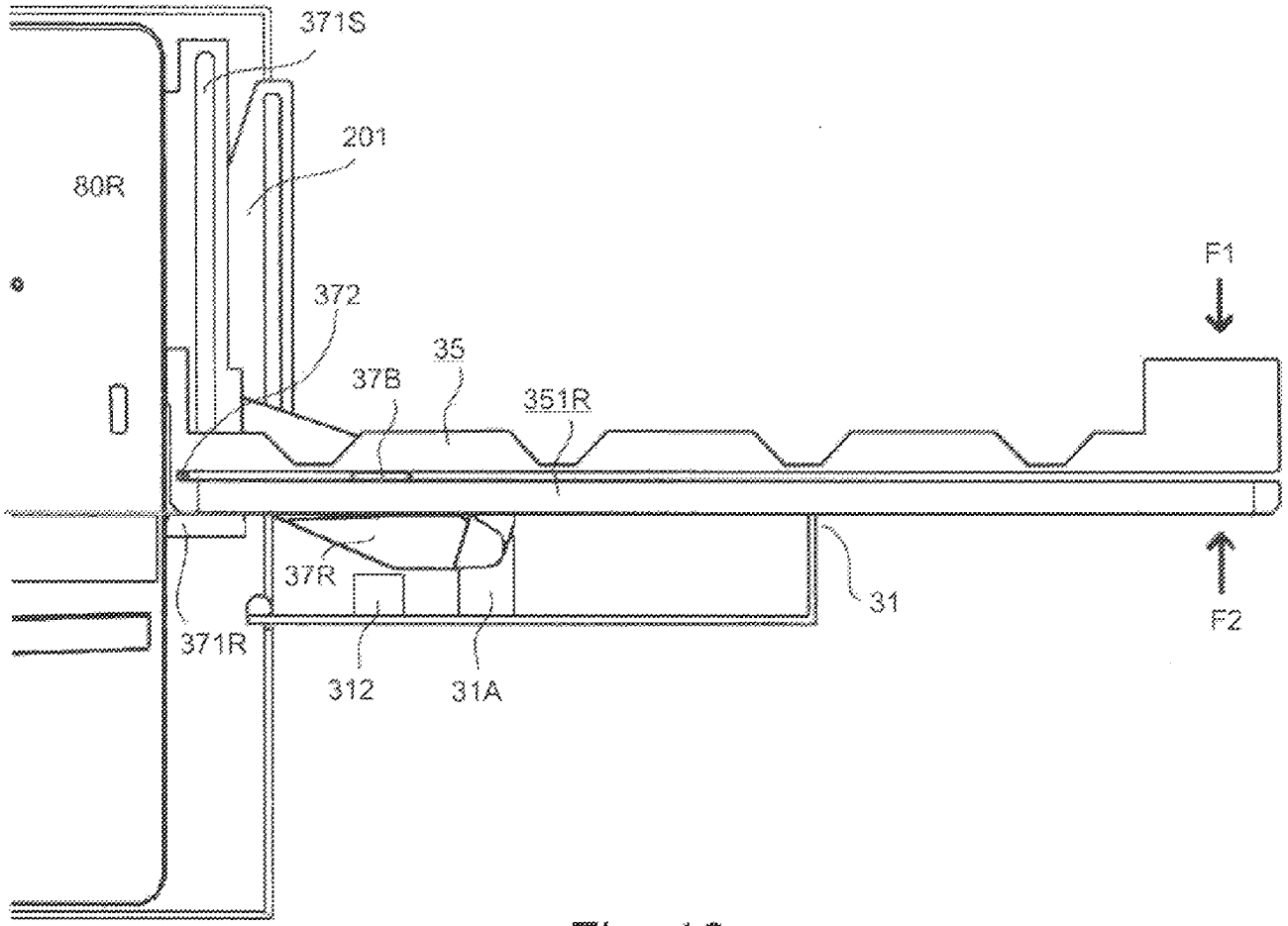

FIG. 13 is a sectional drawing of a combination of the front portion of the main assembly of the image forming apparatus, and the cartridge tray of the apparatus, when the tray is in its outermost position.

Figure 14:
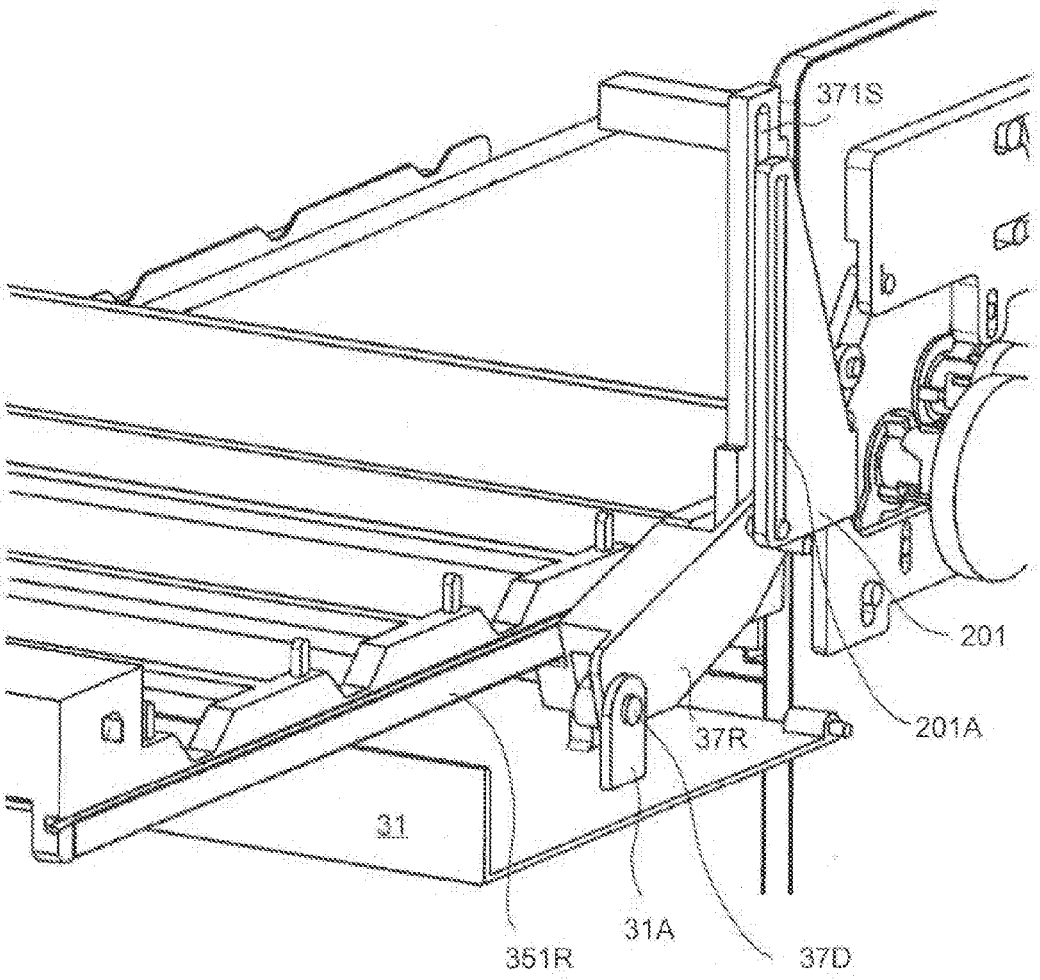

FIG. 14 is a perspective view of the right-front portion of the apparatus main assembly and the cartridge tray, as seen from the side from which the cartridges are driven.

Figure 15:
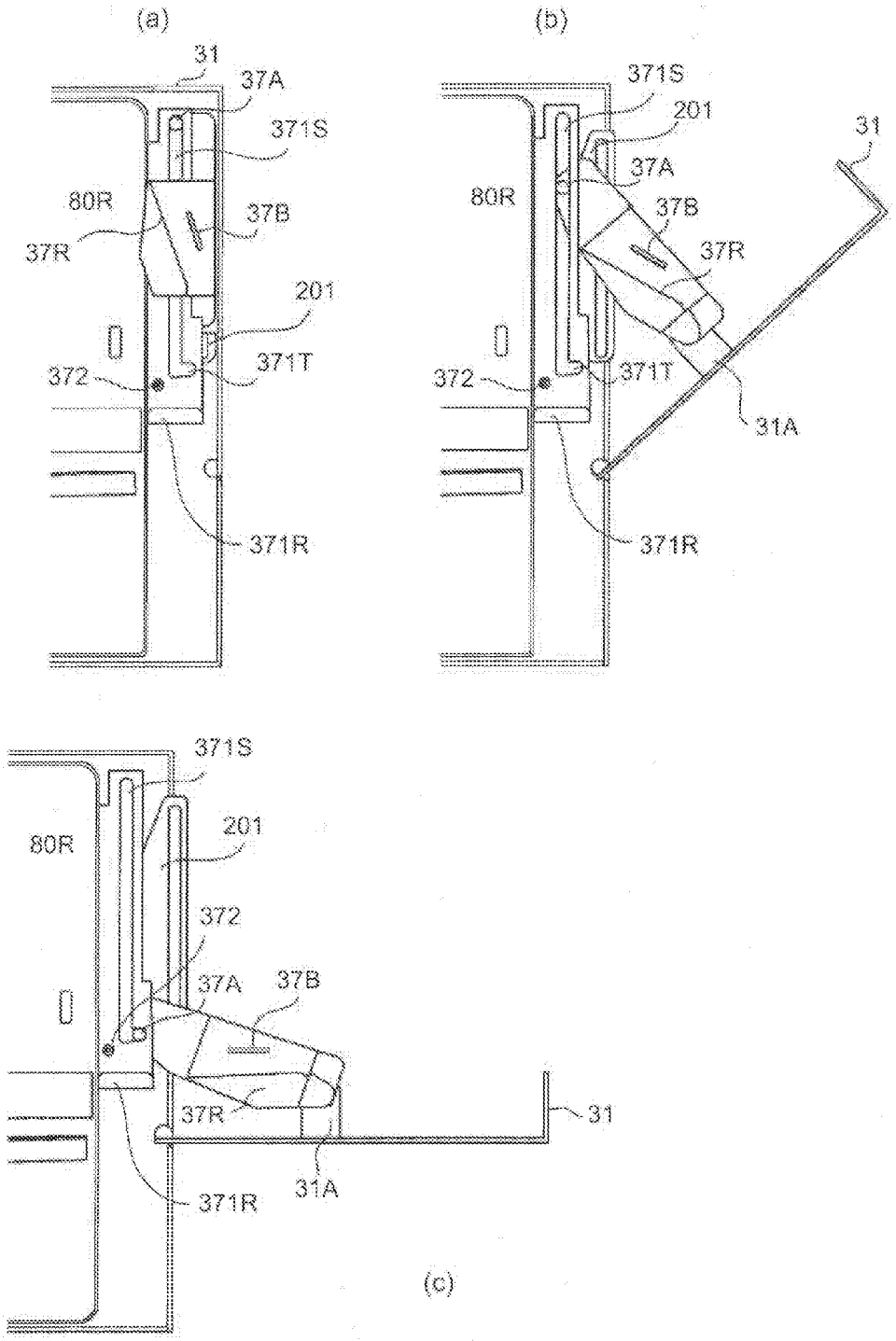

Parts (a), (b), and (c) of FIG. 15 are sectional drawings of the front end portion of the image forming apparatus, when the door of the main assembly is closed, halfway open, and fully open, respectively.

Figure 16:
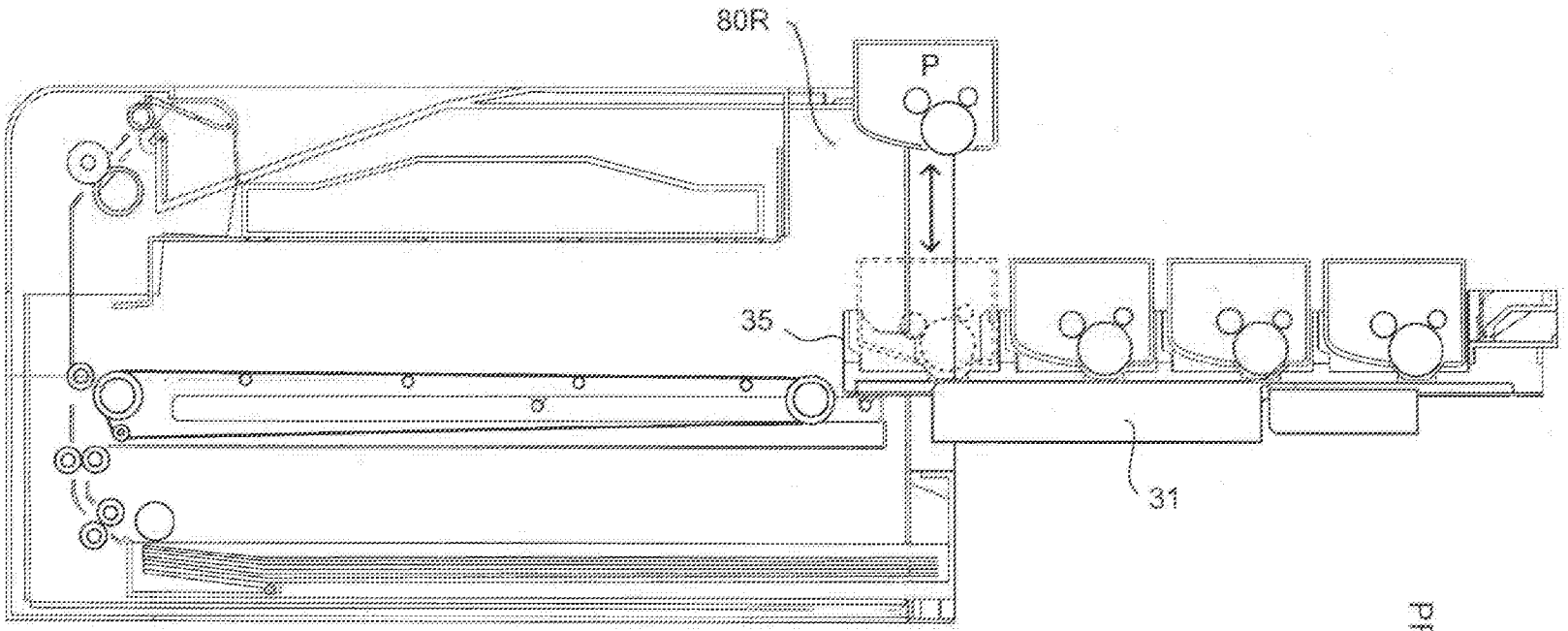

FIG. 16 is a sectional drawing of an example of conventional color image forming apparatus when one of the cartridges in the cartridge tray of the apparatus is being replaced.

DESCRIPTION OF THE EMBODIMENTS

Hereinafter, a few of preferred embodiments of the present invention are described in detail with reference to appended drawings.

Embodiment 1

(Image Forming Apparatus)

Figure 1:
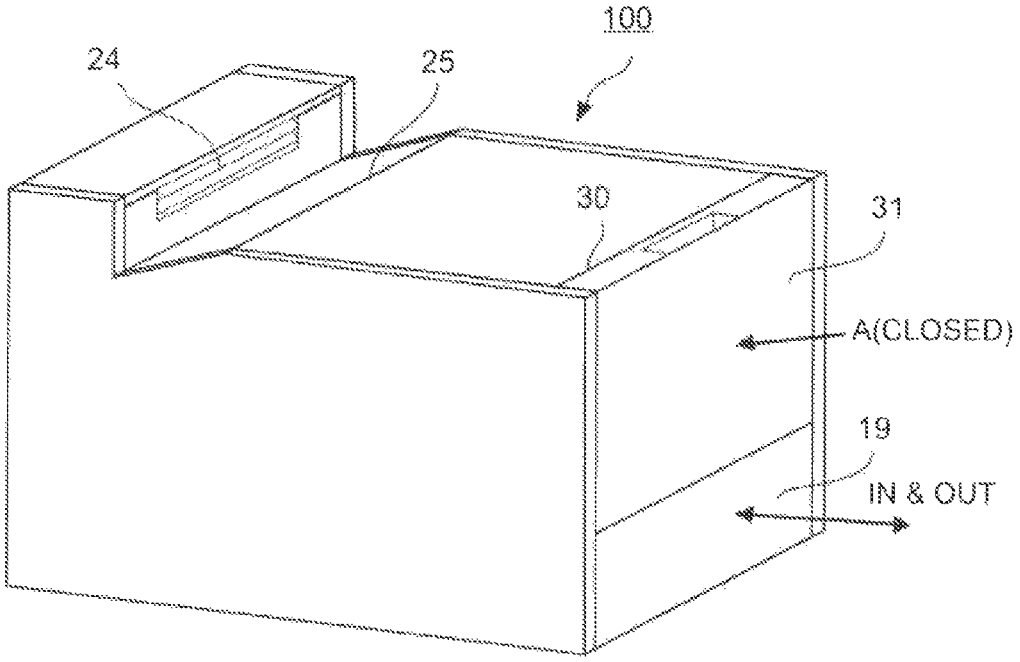
FIG. 1 is an external perspective view of an example of image forming apparatus to which the present invention is applicable.
Figure 2:
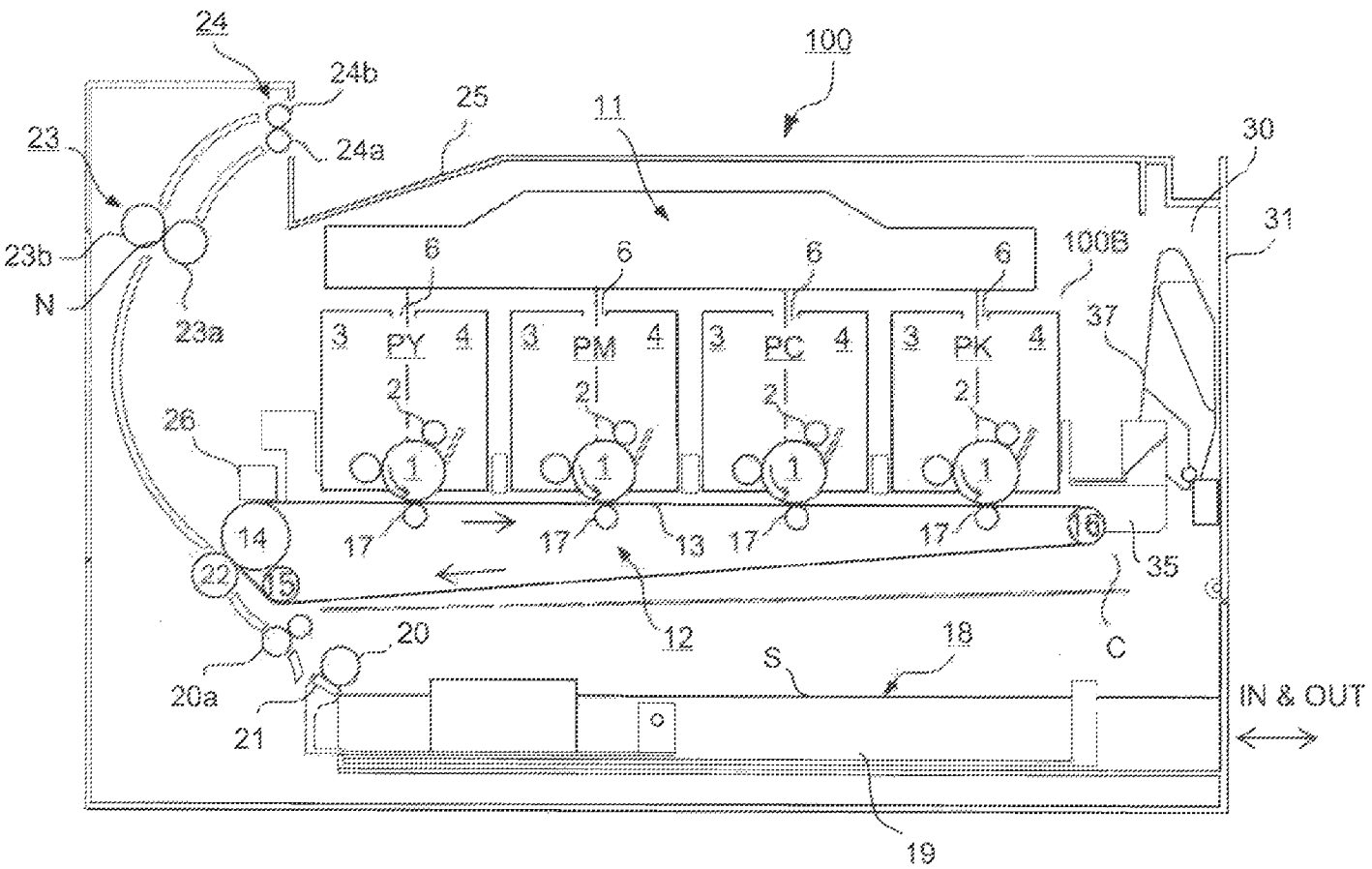
FIG. 2 is a vertical sectional view of the image forming apparatus as seen from the left side of the apparatus.

FIG. 1 is an external perspective view of the image forming apparatus 100 in the first embodiment of the present invention. FIG. 2 is a vertical sectional view of the image forming apparatus 100 as seen from the left side of the apparatus. This image forming apparatus 100 employs multiple (four) cartridges, more specifically, the first to fourth cartridges P (PY, PM, PC and PK, respectively). It is a full-color laser printer (electrophotographic image forming apparatus), which uses an electrophotographic process.

Each of the electrophotographic image forming apparatus in the following embodiments of the present invention is an electrophotographic full-color image forming apparatus, which employs four process cartridges, which are removably installable in the main assembly of the apparatus. However, the following embodiments are not intended to limit the present invention in terms of the number of the process cartridges which the electrophotographic image forming apparatus (which hereafter will be referred to simply as image forming apparatus) holds. The number of process cartridges to be installed in the main assembly of the image forming apparatus, for image formation, is set as necessary. For example, in the case of an image forming apparatus for forming a monochromatic image, the number of the cartridge to be installed in the image forming apparatus is one.

Further, each of the image forming apparatuses in the following embodiments, which is described hereafter, is a printer. However, the embodiments are not intended to limit the present invention in the type of image forming apparatus to which the present invention is applicable. That is, the present invention is applicable to other image forming apparatuses than a printer. For example, the present invention is also applicable to a copying machine, a facsimileing machine, and a multifunction machine capable of functioning as two or more of the aforementioned machines.

Regarding the orientation of the image forming apparatus in each of the following embodiments, the front side (front surface side) is the side where a door 31 (main assembly door) is. The rear side (back side) is the opposite side from the front side. The front-rear direction is the front-to-rear direction (frontward direction indicated by arrow mark X in FIGS. 10(*a*) and 10(*b*)), as well as the opposite direction (rearward direction) from the front-to-rear direction. The left and right sides of the image forming apparatus 100 are the left and right sides as seen from the front side of the apparatus 100. The left-right direction is the left-to-right direction (leftward direction indicated by arrow mark Y in FIGS. 10(*a*) and 10(*b*)), as well as the opposite direction (rightward direction) from the left-to-right direction. The upward and downward directions are the upward and downward directions in terms of the gravity direction. The upward direction (indicated by arrow mark Z in FIGS. 10(*a*) and 10(*b*)) is the bottom-to-top direction, and the downward direction is the top-to-bottom direction.

Further, the lengthwise direction is the direction which is parallel to the rotational axis of the electrophotographic photosensitive component, which is an image bearing component on which a latent image is formed. The widthwise direction is the direction which is perpendicular to the lengthwise direction. One of the lengthwise ends of the image forming apparatus is the side from which the electrophotographic photosensitive component is driven, and the other end is the side from which the electrophotographic photosensitive component is not driven. In this embodiment, the lengthwise right end of the image forming apparatus corresponds to the side from which the photosensitive component is driven, and the lengthwise left end of the apparatus corresponds to the side from which the photosensitive component is not driven.

The image forming apparatus 100 is provided with a cartridge chamber 100B (FIG. 2), which is in the main assembly 100A (FIG. 3) of the image forming apparatus 100. It is in this cartridge chamber 100B in the apparatus main assembly 100A that four cartridges, more specifically, the first to fourth cartridges PY, PM, PC and PK are installable in their preset positions, one for one, so that they horizontally align in the listed order from the rear side (in-line type, tandem-type). The preset cartridge position is a position in the apparatus main assembly 100A, which is preset for a cartridge P, and in which the cartridge P forms an image.

Each cartridge P contributes to an image formation process for forming an image on a sheet S of recording medium. It is used for forming an image on a sheet S of recording medium. It is removably installable in the main assembly 100A of the image forming apparatus 100. Each of the four process cartridges PY, PM, PC and PK in this embodiment has an electrophotographic photosensitive component 1 (which hereafter may be referred to as drum 1), which is an image bearing component on which a latent image is formed. It is in the form of a drum. Further, each process cartridge P has also a charging means 2, a developing means 3, and a cleaning means 4, which are means for processing the drum 1 to form an image. That is, each process cartridge P is of the so-called integration type.

The first cartridge PY contains yellow (Y) toner in its developing means 3. It forms a yellow (Y) toner image on the peripheral surface of its drum 1. The second cartridge PM contains magenta (M) toner in its developing means 3. It forms a magenta (M) toner image on the peripheral surface of its drum 1. The third cartridge PC contains cyan (C) toner in its developing means 3. It forms a cyan (C) toner image on the peripheral surface of its drum 1. The fourth cartridge PK contains black (K) toner in its developing means 3. It forms a black (K) toner image on the peripheral surface of its drum 1.

Further, the image forming apparatus 100 is provided with a laser scanner unit 11, which is an exposing device unit (exposing means) for forming a latent image on the drum 1 of each cartridge P by exposing the drum 1. The laser scanner unit 11 is above the combination of the cartridges PY, PM, PC and PK. It exposes the peripheral surface of the drum 1 of each cartridge P through an exposure window 6, with which the top wall of each cartridge frame is provided, by outputting a beam of laser light while modulating the beam according to the information of one of the monochromatic images, into which an image to be formed was separated.

There is disposed below the combination of cartridges PY, PM, PC and PK, an intermediary transfer unit 12 (transferring component), to which a toner image is transferred (primary transfer) from the drum 1 of each cartridge P. The intermediary transfer unit 12 transfers (secondary transfer) the toner image transferred thereto, onto a sheet S of recording medium.

This unit 12 has a flexible endless belt 13, a driver roller 14, a turn roller 15, and a tension rollers 16. The endless belt 13 is an intermediary transferring component (second image bearing component: intermediary recording medium). It is formed of a dielectric substance. It is suspended and kept tensioned by the three rollers 14, 15, and 16, and is circularly moved. The driver roller 14 and turn roller 15 are disposed in the rear portion of the apparatus main assembly 100A, whereas the tension roller 16 is disposed in the front portion of the apparatus main assembly 100A.

When each cartridge P is in its preset image formation position in the apparatus main assembly 100A, the downwardly facing portion of the peripheral surface of its drum 1 is in contact with the top surface of the top side of the belt 13 with reference to the loop (belt loop) which the belt 13 forms. There are disposed on the inward side of the belt loop, four primary transfer rollers 17 which oppose the four drums 1, one for one, with the presence of the top portion of the belt loop between each transfer roller 17 and corresponding drum 1.

The nip between the drum 1 of each cartridge P and the belt 13 is the primary transfer nip. The driver roller 14 is positioned in a manner to oppose the secondary transfer roller 22 with the presence of the belt 13 between the two rollers 14 and 22. The nip between the secondary transfer roller 22 and belt 13 is the secondary transfer nip.

There is a sheet feeding unit 18 below the intermediary transfer unit 12. The sheet feeding unit 18 stores a substantial number of sheets of recording medium onto which a toner image is transferred. It conveys the sheets S of recording medium, one by one, to the intermediary transfer unit 12.

This sheet feeding unit 18 has: a sheet feeder tray 19 in which sheets S of recording medium (which hereafter may be referred to as recording medium S) are stored in layers; a feeder roller 20; a separation pad 21; a pair of registration rollers 20*a*; etc. The sheet feeding unit 18 can be inserted into, or pulled out of, the apparatus main assembly 100A from the front side of the apparatus main assembly 100A (front loading).

Further, there is disposed in the top-rear portion of the apparatus main assembly 100A, a fixing device 23 and a pair of discharge rollers 24. The fixing device 23 is a fixation unit (fixing means) which fixes a toner image transferred onto a sheet S of recording medium, to the sheet S by applying heat and pressure to the sheet S and the toner image thereon, and discharges the sheet S. A part of the top surface of the top wall of the apparatus main assembly 100A is shaped as a delivery tray 25. The fixing device 23 employed in this embodiment has a fixation film assembly 23*a* and a pressure roller 23*b*. The pair of discharge rollers 24 is a combination of discharge rollers 24*a* and 24*b*.

As each cartridge P is moved into the cartridge chamber 100B, it is moved into its preset image formation position, and is kept in the image formation position by a pressing component 42 of the apparatus main assembly 100A (FIG. 9). Further, the driving force output sections 39 and 40 (driving force transmitting components) of the apparatus main assembly 100A (FIG. 6) engage with the driving force input sections (driving force transmission joints 53 and 54 (FIG. 7)). Further, the electric power supplying system (electrical power supplying component) of the apparatus main assembly 100A comes into contact with the electrical contact 55 (electric power supplying contact) of the cartridge P, establishing an electrical connection between the apparatus main assembly 100A and the cartridge P.

(Image Forming Operation)

An operation for forming a full-color image is as follows. The drum 1 in each of the first to fourth cartridges PY, PM, PC and PK is rotationally driven at a preset control speed in the counterclockwise direction indicated by an arrow mark in FIG. 2. The belt 13 is rotationally driven in the clockwise direction indicated by another arrow mark (so that it moves in the same direction in area of contact between drum 1 and belt 13) at a speed which corresponds to the speed of the drum 1. Further, the scanner unit 11 is driven.

In synchronism with the driving of the abovementioned components, the charging means 2 in each cartridge P uniformly charges the peripheral surface of the drum 1 in each cartridge P to preset polarity and potential level. As for the scanner unit 11, it exposes the uniformly charged peripheral surface of the drum 1; it scans the peripheral surface of the drum 1 with a beam of laser light which it outputs while modulating the beam with image formation signals which correspond to the color of the monochromatic image which the cartridge P is to form. Consequently, an electrostatic latent image, which reflects the image formation signals, is effected on the peripheral surface of the drum 1. Then, the latent image is developed into a toner image (developer image) by the developing means 3.

Through an electrophotographic image formation process such as the above-described one, a yellow (Y) toner image, which corresponds to the yellow component of the full-color image to be formed, is formed on the peripheral surface of the drum 1 in the first cartridge PY. This toner image is transferred (primary transfer) onto the belt 13, in the primary transfer nip of the cartridge PY.

On the drum 1 of the second cartridge PM, a magenta (M) toner image which corresponds to the magenta (M) component of the full-color image to be formed, is formed. This toner image is transferred (primary transfer) onto the belt 13, in a manner to be layered upon the yellow (Y) toner image which has just been transferred onto the belt 13, in the primary transfer nip of the cartridge PM.

On the drum 1 of the third cartridge PC, a cyan (C) toner image which corresponds to the cyan (C) component of the full-color image to be formed, is formed. This toner image is transferred (primary transfer) onto the belt 13, in a manner to be layered upon the yellow (Y) and magenta (M) toner images, which have just been transferred onto the belt 13, in the primary transfer nip of the cartridge PC.

On the drum 1 of the fourth cartridge PK, a black (K) toner image which corresponds to the black (K) component of the full-color image to be formed, is formed. This toner image is transferred (primary transfer) onto the belt 13, in a manner to be layered upon the yellow (Y), magenta (M), and cyan (C) toner images, which have just been transferred onto the belt 13, in the primary transfer nip of the cartridge PK.

Consequently, an unfixed full-color toner image is synthetically formed of yellow (Y), magenta (M), cyan (C), and black (K) monochromatic images, on the belt 13. Transfer residual toner, that is, the toner remaining on the peripheral surface of the drum 1 in each cartridge P after the primary transfer of the toner image in the cartridge P onto the belt 13, is removed by a cleaning device 4.

Meanwhile, the sheet feeding roller 20 begins to be driven with preset timing, whereby the recording mediums S, stored in layers in the sheet feeding tray 19, begins to be fed in the apparatus main assembly 100A, while being separated one by one, and is guided into the secondary transfer nip by the pair of registration rollers 20*a* to be conveyed through the nip. While each recording medium S is conveyed through the secondary transfer nip, the four toner images which are different in color and are layered on the belt 13 are transferred together onto the recording medium S as if they are peeled away from the belt 13.

Then, the recording medium S is separated from the surface of the belt 13, and is guided into the fixing device 23 through a recording medium conveyance passage, to be conveyed through the fixation nip N of the fixing device 23. While the recording medium S is conveyed through the fixation nip N, it is heated while being compressed. Consequently, the four toner images, different in color, on the recording medium S become fixed to the recording medium S while mixing with each other. Thereafter, the recording medium S is moved out of the fixing device 23. Then, it is discharged, as a finished full-color print, onto the delivery tray 25 by the pair of discharge rollers 24. Secondary transfer residual toner, that is, the toner remaining on the belt 13 after the separation of the recording medium S from the belt 13, is removed by a cleaning device 26.

(Method for Replacing Cartridge)

Regarding the method for replacing the cartridges P in the apparatus main assembly 100A, for the purpose of improving the image forming apparatus 100 in this embodiment, the apparatus 100 is structured so that each of the cartridges P is mounted on a tray 35 (drawer), which can be accessed from the front side of the apparatus main assembly 100A. More concretely, the front wall of the apparatus main assembly 100A is provided with an opening 30, through which the tray 35 can be inserted into, or moved out of, the cartridge chamber 100B in the apparatus main assembly 100A, in order to place each cartridge P in the cartridge chamber 100B, or remove each cartridge P from the cartridge chamber 100B. Further, the front wall is provided with a door 31, which is pivotally movable between its position A (which hereafter may be referred to as "closed position", for convenience sake) in which it keeps the opening 30 completely covered as shown in FIGS. 1 and 2, and its position B (which hereafter may be referred to as "open position" for convenience sake) in which it keeps the opening 30 fully exposed as shown in FIGS. 3 and 4.

In this embodiment, this door 31 is pivotally (rotatably) movable relative to the apparatus main assembly 100A, about a horizontal shaft 37 (hinge) which extends along the bottom edge of the door 31. That is, when the door 31 is in its open position B, it can be pivotally (rotationally) moved upward about the hinge shaft 31 to be positioned upright to completely cover the opening 30, as shown in FIGS. 1 and 2. That is, as the door 31 is closed as described above, the opening 30 is completely covered by the door 31.

Figure 3:
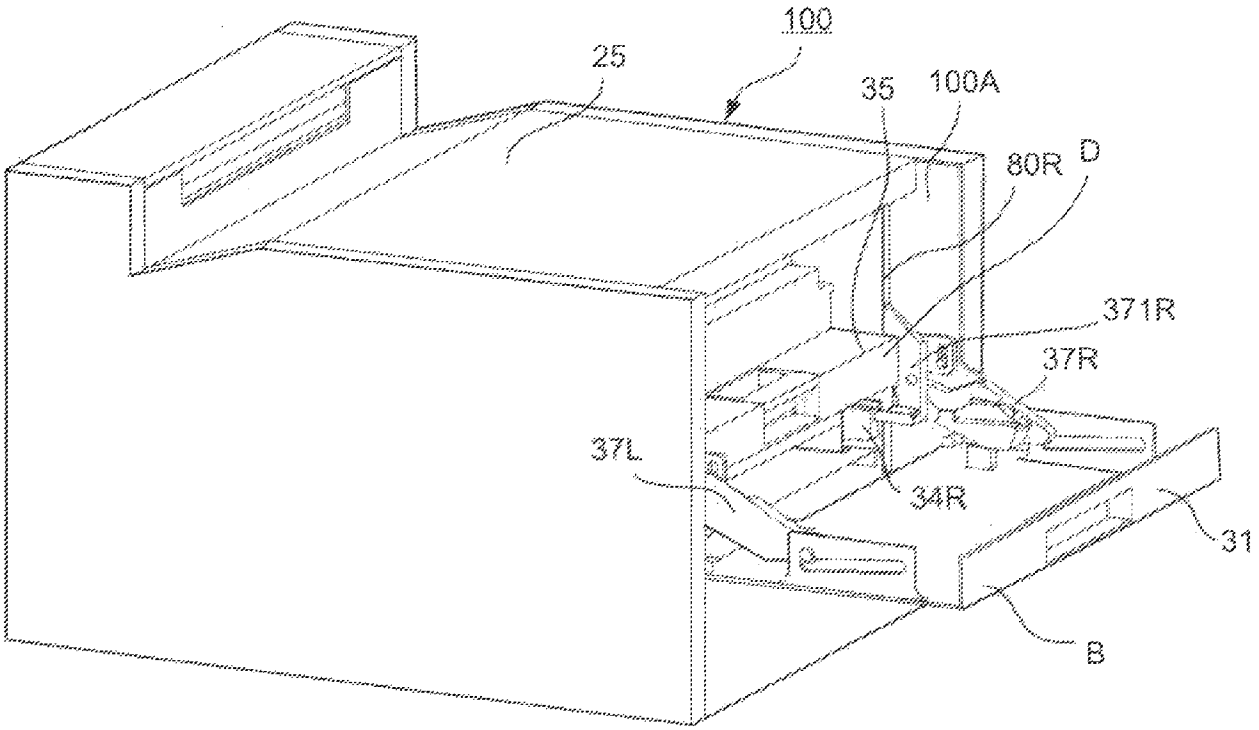
FIG. 3 is an external perspective view of the image forming apparatus when the door of the apparatus is fully open.
Figure 4:
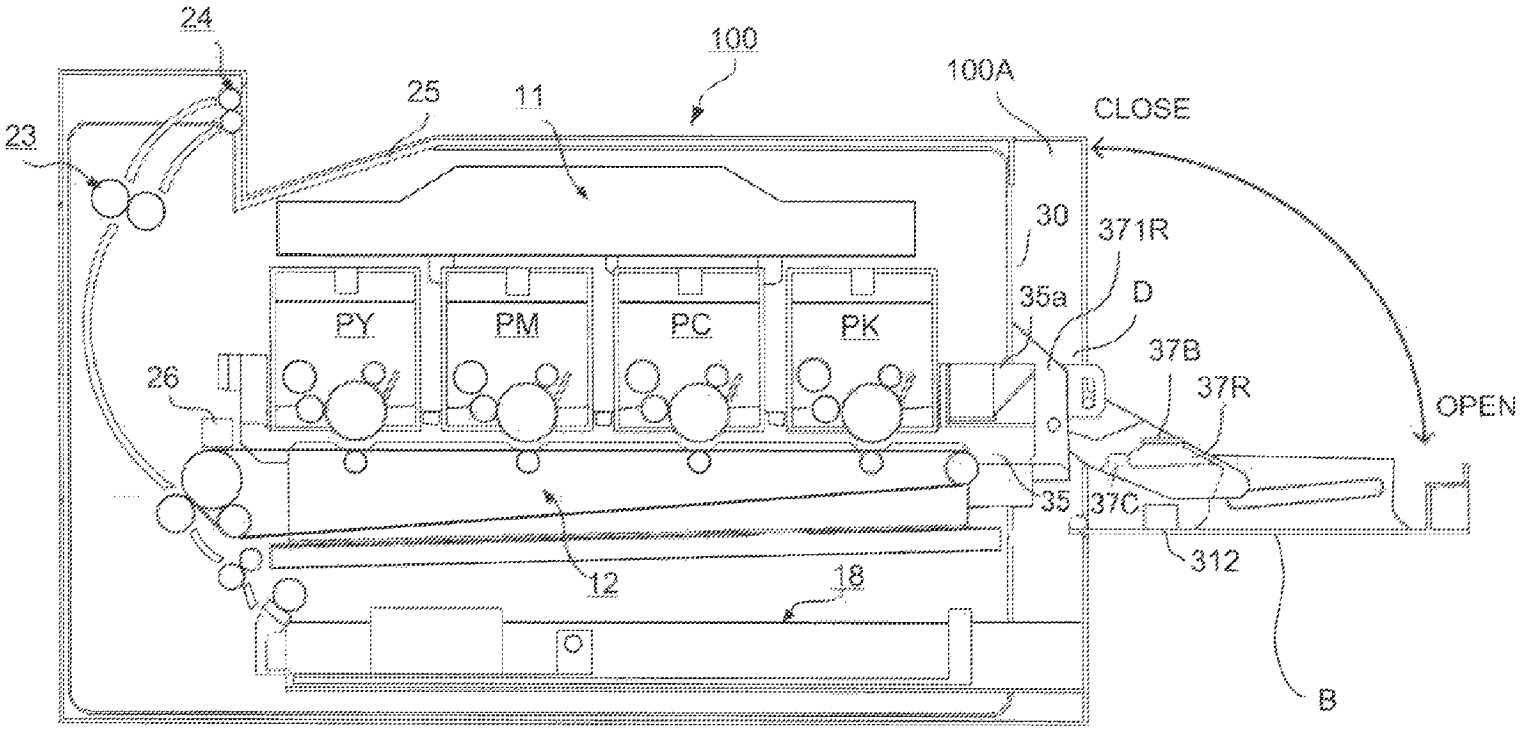
FIG. 4 is a vertical sectional view of the image forming apparatus, shown in FIG. 3, as seen from the left side of the apparatus when the apparatus is in the state shown in FIG. 3.

Further, when the door 31 is in its closed (upright) position A, it can be pivotally (rotationally) moved frontward until it becomes horizontal so that it is put in its open position B as shown in FIGS. 3 and 4. As the door 31 is moved into its open position B, the opening 30 of the front wall of the apparatus main assembly 100A becomes fully exposed (open state).

The apparatus main assembly 100A has a main frame (main assembly frame), which has the left and right sub-frames 80L and 80R. It has also a pair (left and right) of tray supporting components 34L and 34R (holding components), which are disposed between the left and right sub-frames 80L and 80R.

The cartridge tray 35 (supporting component), which is roughly in the form of a ladder, is supported by these tray holding components 34L and 34R, between the left and right sub-frames 80L and 80L, in such a manner that the cartridge tray 35 can be slidingly moved on the tray holding components 34L and 34R, between its position D (outward-movement-possible position), shown in FIG. 4, or the outermost position relative to the apparatus main assembly 100A, in which it allows cartridges P to be mounted into, or removed from, the tray 35. The cartridges PY, PM, PC and PK are supported in the apparatus main assembly 100A by being mounted in this cartridge tray 35. The tray 35, which is a supporting component for supporting cartridges P, is such a component that can be slidingly moved in the direction which is perpendicular to the axial line (lengthwise direction) of the drum 1 which each cartridge P has.

That is, the direction in which the tray 35 is moved between the position D (outward-movement-possible position in apparatus main assembly 100A) which enables the tray 35 to be moved outward, and the position E (which is outside apparatus main assembly 100A) is perpendicular to the lengthwise direction of each cartridge P. Multiple cartridges P can be mounted in tandem in the tray 35, in the direction in which the tray 35 is moved between the positions D and E. That is, the tray 35 is such a movable component that can be moved while supporting two or more cartridges P. It is movable between the left and right sub-frames 80L and 80R (FIG. 3), which are parts of the main frame of the apparatus main assembly 100A and oppose each other.

Referring to FIG. 1, when the door 31 is in its closed position A, the tray 35 is in its image formation position C (preset position), shown in FIG. 2, in which it keeps each cartridge P ready for image formation. In this embodiment, when the tray 35 is in its image formation position C (inside position) for the tray 35, the drum 1 in each cartridge P is in contact with the belt 13 of the intermediary transfer unit 12 (FIG. 2).

As the door 31 is pivotally moved to be opened, the tray holding components 34L and 34R are moved frontward by a preset amount while being moved upward by a preset amount, by the movement of the door 31. Consequently, the tray 35 is moved from its image formation position C (inside position), shown in FIG. 2, to the position D (outward-movement-possible position), by being moved frontward while being moved upward. Referring to FIG. 4, this movement of the tray 35 causes the drum 1 of each of the cartridges P supported by the tray 35, to separate from the belt 13.

Further, as the door 31 is opened (pivotally moved downward), the electrical contact 55 (part (a) of FIG. 7) of each cartridge P is disconnected from the electric power supplying system of the apparatus main assembly 100A (FIG. 4) by the movement of the door 31 (electrical power supply disengagement). Further, the driving force input sections 53 and 54 (FIG. 7(*b*)) of each cartridge P are disengaged from the driving force outputting sections 39 and 40 (FIG. 6) (driving power disengagement) by the movement of the door 31. Moreover, each cartridge P is freed from the pressure applied thereto by the pressing component 42 (FIG. 9) to keep the cartridge P fixed in position (pressure removal).

In order for a user to pull the tray 35 out of the apparatus main assembly 100A, to move the tray 35 from the position D (outward-movement-possible position) to the position E (preset for mounting or dismounting cartridges) after the above-described opening of the door 31, the user has to grasp the tray handle 35*a* (tray unlocking means) exposed through the opening 30 which was exposed by the opening of the door 31. As the handle 35*a* is grasped in a preset manner, an unshown pop-up prevention claw (tray movement regulating means) disengages from the unshown catch of the apparatus main assembly 100A, freeing thereby the tray 35.

Thus, it becomes possible for the tray 35 to be pulled out of the apparatus main assembly 100A, from the position D (outward-movement-possible-position) in the apparatus main assembly 100A. That is, it becomes possible for the tray 35 to be horizontally slid frontward on the tray holding components 34L and 34R (FIG. 3), through the opening 30 (FIG. 2), to the position E (preset for mounting or dismounting of cartridge) which is outside the apparatus main assembly 100A. In other words, it becomes possible to make the tray 35 to protrude from the apparatus main assembly 100A so that a cartridge P can be mounted into, or removed from, the tray 35.

As the door 31 is fully opened as described above, all of the first to fourth cartridges PY, PM, PC and PK held by the tray 35 are exposed from the apparatus main assembly 100A by being moved out of the apparatus main assembly 100A through the opening 30; the top side of each cartridge is exposed. The apparatus main assembly 100A is provided with a pair of connective arm holders 371L and 371R (FIG. 3), which are attached to the side walls 80L and 80R (FIG. 3). Further, each of the connective arm holders 371L and 371R is provided with a tray retention pin 372 as a tray stopper. Thus, as the tray 35 is moved outward from the position D (outward-movement-possible-position) by a preset amount, the rear end of the tray 35 comes into contact with the tray retention pins 372, whereby the tray 35 is prevented from being drawn further outward.

After the tray 35 is drawn out to the position E (preset position for mounting or dismounting cartridges), it is made to remain horizontal by the connective arm holders 371L and 371R, which will be described later.

When the tray 35 is in the position E (for mounting or dismounting cartridges), it is supporting each cartridge P in such a manner that each cartridge can be moved out of the tray 35 by being pulled upward. Further, the tray 35 supports each cartridge P by preventing each cartridge from moving downward. Thus, a cartridge P which has reached the end of its life span, and therefore, is to be replaced, can be moved out of the tray 35 by being pulled upward, as indicated by a broken line in FIG. 6, so that a brand-new cartridge P can be vertically inserted from above, into the space in the tray 35 vacated by the removed cartridge P. That is, it is when the tray 35 is out of the apparatus main assembly 100A that the cartridges P can be installed into, or uninstalled from, the apparatus main assembly 100A.

The tray 35 of the image forming apparatus 100 in this embodiment supports the cartridges PY, PM, PC and PK so that the cartridges P align in the listed order, in the direction in which the tray 35 is moved from the position D (outward-movement-possible position) to the position E (for mounting or dismounting cartridges). That is, the cartridges PY, PM, PC and PK which contain yellow (Y), magenta (M), cyan (C) and black (K) toners, respectively, are supported by the tray 35 in the listed order in terms of the direction in which the tray 35 is moved from the position D to the position E. That is, among the multiple (four) cartridges P which are different in the color of the developer they contain, the cartridge PK which contains the black (K) toner is supported most downstream in terms of the direction in which the tray 35 is moved from the position D to the position E.

The cartridge PK is greater in the amount by which developer is consumed from a cartridge, than other cartridges. That is, it is higher in replacement frequency than the others. This cartridge PK is supported by the frontmost end of the tray 35. Thus, if it is only the cartridge PK that needs to be replaced, it is only the cartridge PK that has to be exposed. The tray 35 has to be pulled out of the apparatus main assembly 100A only slightly to expose only the cartridge PK from the apparatus main assembly 100A.

That is, if it is only the cartridge PK that needs to be replaced, it is unnecessary to pull the tray 35 out of the apparatus main assembly 100A far enough for the movement of the tray 35 to be regulated by the stopper. In other words, this embodiment improves the image forming apparatus 100 in the efficiency with which the cartridge PK can be replaced. That is, the multiple cartridges P on the tray 35 can be removed one by one from the downstream side in terms of the direction in which the tray 35 is moved, by incrementally moving the tray 35 from the position D (outward-movement-possible position) to the position E (for mounting or dismounting cartridges). Obviously, when the tray 35 is in the position E, all the cartridges P can be removed from the tray 35.

(Tray)

FIG. 8 is an external perspective view of the tray 35. This tray 35 has a rectangular frame, and three partition plates 35*f* which separate the space in the frame into four smaller rectangular spaces which are roughly equal in size, and the lengthwise direction of which is perpendicular to the moving direction of the tray 35. More concretely, the three partition plates 35*f* extend in the direction which is perpendicular to the moving direction of the tray 35. They create the first to fourth sub-spaces 35(1)-35(4), naming from the rear side. These sub-spaces 35(1)-35(4) are where the first to fourth cartridges P are to be held, respectively.

Each cartridge P is to be inserted into its designated sub-space from above, until the slant surfaces of each of the grooves 59L and 59R (parts (a) and (b) of FIG. 7) of each cartridge P, which is for temporarily positioning the cartridge P, is caught by semi-cylindrical end of corresponding protrusion 35*g* (one of eight protrusions 35) with which the tray 35 is provided to temporarily position the cartridge P, and, the downwardly facing surface of each of the left and right eave-like portions 56 (parts (a) and (b) of FIG. 7) is caught by the upwardly facing surface of the left and right sections 35*d* and 35*e* (FIG. 8) of the frame of the tray 35. Consequently, not only is each cartridge P supported by the tray 35, but also, it is precisely positioned relative to the tray 35. That is, the tray 35 supports each cartridge P so that each cartridge P can be upwardly extracted from the tray 35; each cartridge P is supported by the tray 35 by being downwardly lowered into the tray 35.

Regarding the positioning of each cartridge P relative to the tray 35 in terms of the front-rear direction, as the slant portions of each of the temporarily positioning grooves 59L and 59R of each cartridge P comes into contact with the semi-cylindrical portion of the positioning (temporarily) protrusion 35*g* of the tray 35, the cartridge P is precisely positioned relative to the tray 35. Therefore, the tray 35 is structured so that, in terms of the direction parallel to the axial line of the drum 1 of each cartridge P, the dimension of each of the rectangular sub-spaces 35(1)-35(4) is slightly greater than the dimension of the cartridge P. The provision of this structural arrangement makes it easier to replace cartridges P.

Further, in order to reduce the tray 35 in size, weight, and cost, the tray 35 is formed of such plastic (ABS, for example) that is low in rigidity. Further, the tray 35 is shaped so that its left and right plates are relatively low in height. Regarding the height of the left and right plates of the tray 35, the right plate needs to be large enough to afford a space for the connection between the driving force input sections 53 and 54 and the driving force output sections 39 and 40, whereas the left plate needs to be large enough to afford a space for allowing the electrical contact 55 to come into contact with the unshown electric power supplying system, and also, for the cartridge positioning section 57 for positioning the cartridge P in terms of the lengthwise direction, to come into contact with the left frame 80L. Therefore, the left and right plates should not be unnecessary tall, from the standpoint of the structure of the apparatus main assembly 100A.

Because the material and shape for the tray 35 are chosen from the abovementioned standpoint, the tray 35 is relatively low in rigidity. Therefore, the tray 35 is provided with a pair of reinforcement plates 351L and 351R (FIG. 8), which are attached to the bottom side of the left and right plates of the tray 35, respectively. Thus, even if a user accidentally applies a substantial amount of force to the tray 35 when the tray 35 is kept in the position E for cartridge replacement by a user (for example, even if user applies an unnecessarily large amount of force to cartridge P to insert or extract cartridge P), the tray 35 is prevented from being damaged by the force. By the way, it is assumed here that in this embodiment, a steel plate which is roughly 1 mm in thickness is used as the material for the reinforcement plates 351L and 351R. However, the material for the reinforcement plates 351L and 351R may be a highly rigid plastic.

The left and right sections 35*d* and 35*e* of the frame of the tray 35 are supported by their bottom surface, by the left and right tray holding components 34L and 34R (FIG. 3), with the presence of the reinforcement plates 351L and 351R between the left and right sections 35*d* and 35*e* and the left and right tray holding components 34L and 34R, respectively. Thus, the tray 35 is allowed to horizontally slide on the top surface of the tray holding components 34L and 34R in the front-rear direction.

Figure 5:
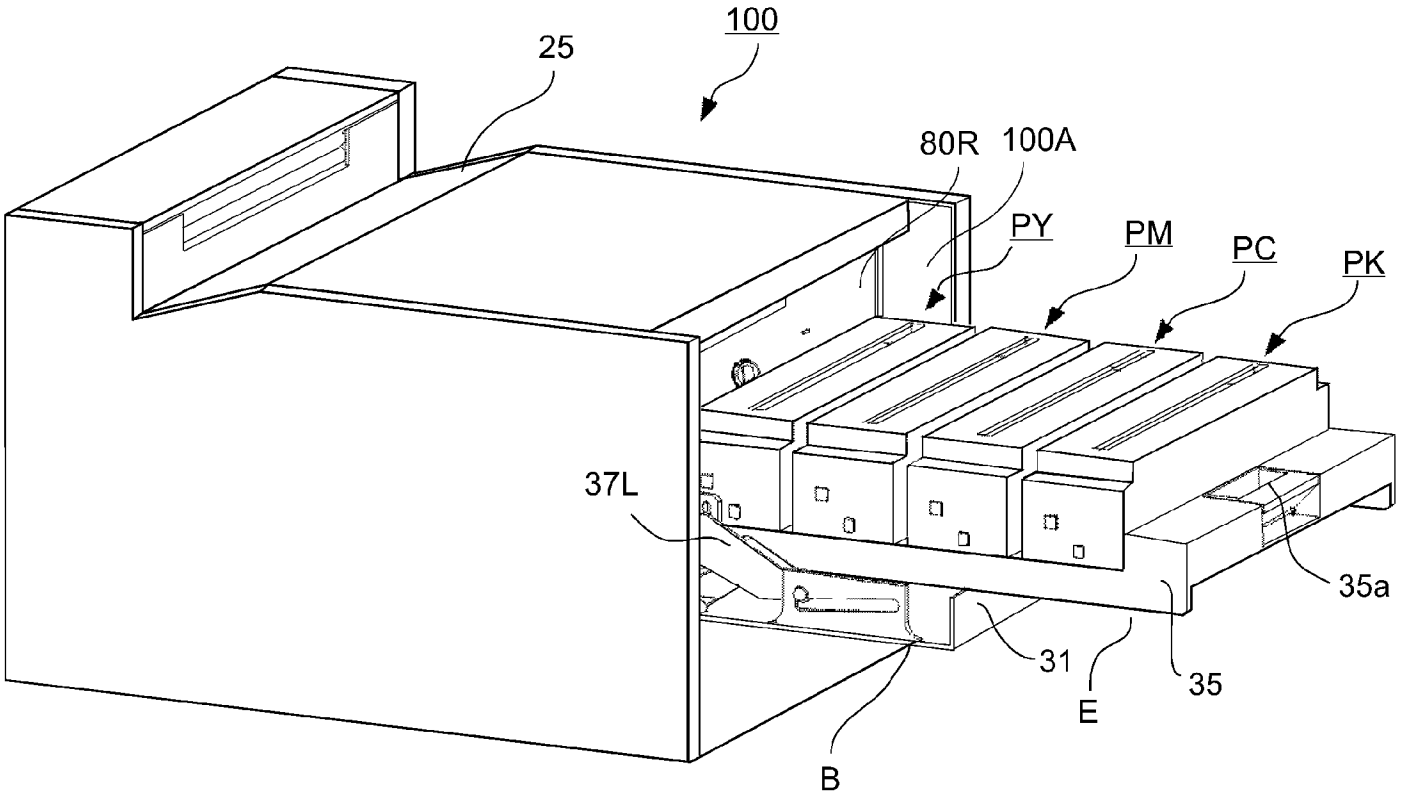
FIG. 5 is an external perspective view of the image forming apparatus when the cartridge tray of the apparatus is in its outermost position relative to the main assembly.
Figure 6:
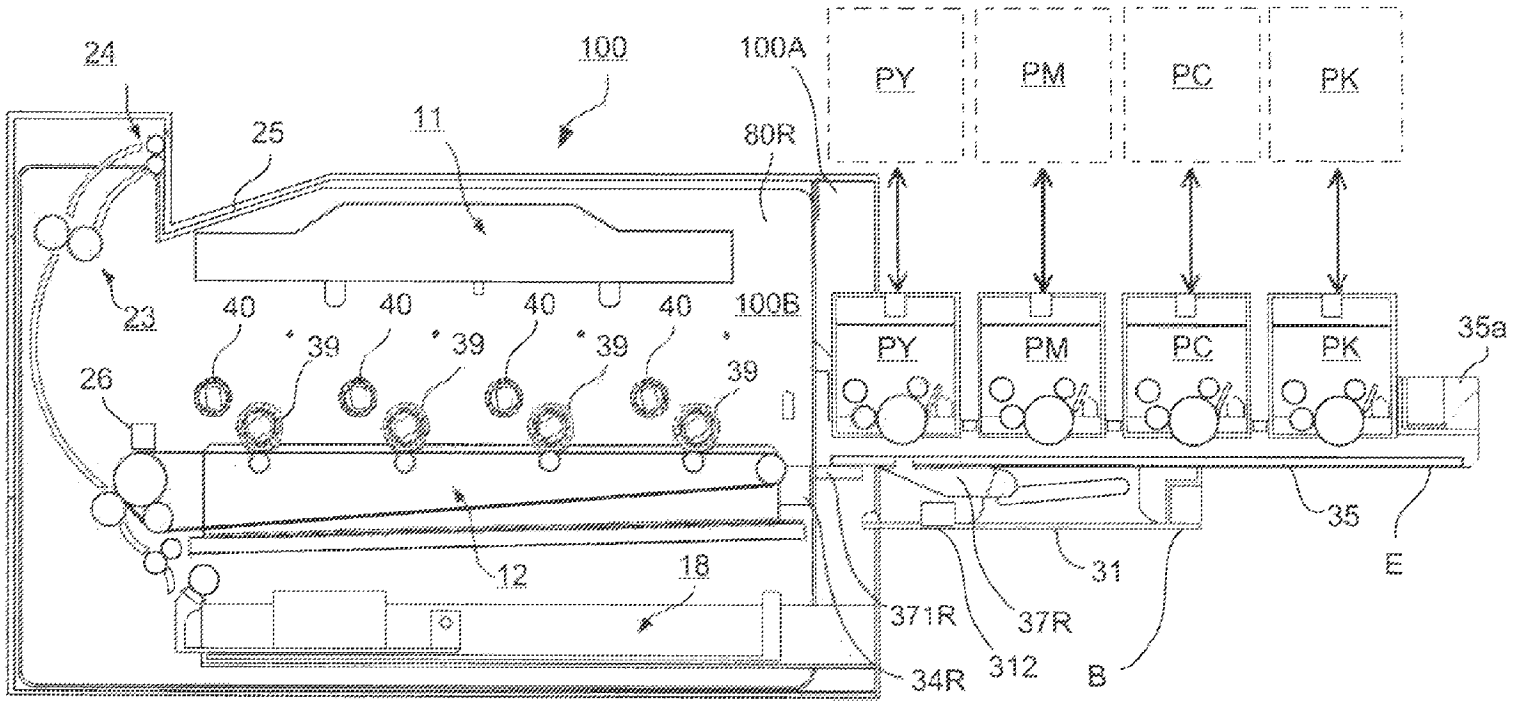
FIG. 6 is a vertical sectional view of the image forming apparatus, as seen from the left side of the apparatus, when the cartridge tray of the apparatus is holding cartridges, and is in its outermost position relative to the main assembly.

Next, referring to FIGS. 5 and 6, if it is necessary for one or more cartridges P in the tray 35 to be replaced, the tray 35 is to be pulled out of the apparatus main assembly 100A to the position E (where the cartridges P can be mounted into, or dismounted from, the tray 35). After the cartridge P (or cartridges P) is replaced, the tray 35 is to be pushed all the way back into the apparatus main assembly 100A so that the tray 35 is positioned where it was in the apparatus main assembly 100A, as shown in FIGS. 3 and 4, before it was pulled out of the apparatus main assembly 100A.

As the tray 35 is pushed back far enough into the apparatus main assembly 100A so that it is placed in the position D (outward-movement-possible position), the unshown pop-out prevention claw (movement regulating means) engages with the unshown catch section of the apparatus main assembly 100A. Further, the tray 35 is pressed downstream by the unshown tray pressing component, in terms of the direction in which the tray 35 is pulled out of the apparatus main assembly 100A. Thus, the pop-up prevention claw and the claw catch of the apparatus main assembly 100A are kept tightly in contact with each other. Through the above-described steps, the tray 35 is pushed back into the position D (outward-movement-possible position) in the apparatus main assembly 100A from the position E (for mounting or dismounting cartridges), and is kept in the position D (outward-movement-possible position).

Then, as the open door 31 is closed as shown in FIGS. 1 and 2, the image forming apparatus 100 becomes ready for an image forming operation. That is, as the door 31 is moved from its open position B to its closed position A, the tray holding components 34L and 34R are moved rearward by the preset amount while being moved downward by the preset amount, by the rotational movement of the door 31. That is, the tray 35 is moved from the position D (outward-movement-possible position) to the image formation position C.

Further, as the door 31 is pivotally closed, the driving force input sections 53 and 54 (parts (a) and (b) of FIG. 7) of each cartridge P are made to engage with the driving force output sections 39 and 40 (FIG. 6) of the apparatus main assembly 100A, by the movement of the door 31. During this movement of the door 31, each cartridge P comes under the pressure from the driving force output sections 39 and 40 of the apparatus main assembly 100A, being thereby moved toward its lengthwise end, from which it is not driven (leftward), as shown in FIG. 9. Consequently, the positioning protrusion 57 (part (a) of FIG. 7), which is for positioning the cartridge P in terms of the left-right direction, comes into contact with the left frame 80L, whereby the cartridge P is precisely positioned in terms of the left-right direction.

Thereafter, each cartridge P remains under the pressure from the pressing component 42 (FIG. 9), and therefore, remains in the preset position. Further, the electrical contact 55 (part (a) of FIG. 7) of each cartridge P comes into contact with the electric power supply system of the apparatus main assembly 100A, establishing thereby electrical connection between the cartridge P and apparatus main assembly 100A.

(How Tray is Held)

Next, how the tray 35 is held while a cartridge P is replaced, which characterizes the present invention, is described in detail. FIG. 11 is a sectional view of the front end portion of the apparatus main assembly 100A, and the tray 35, when the tray 35 is in its outermost position. It shows how the tray 35 is held in its outermost position.

1) Control of Tray Movement

If it is necessary for a user to replace a cartridge P in the apparatus main assembly 100A, the user has to open the door 31, and pull the tray 35 out of the apparatus main assembly 100A, as shown in FIG. 6. When the tray 35 is in its outermost position as shown in FIG. 6, the rear end of the tray 35 is on the downstream side of the main frame of the apparatus main assembly 100A in terms of the direction in which the tray 35 was moved out of the apparatus main assembly 100A.

Referring again to FIG. 6, the downstream movement of the tray 35 is regulated by the connective arm holding sections 371L and 371R, on the bottom side of the tray 35. Next, referring to part (b) of FIG. 10, the tray regulating section 37B (tray regulating first section) of the connective arm 37R prevents the tray 35 from moving upward (in vertical direction), by coming into contact with the top portion of the reinforcement plate 351R as if it bites the reinforcement plate 351R from the top side.

Next, referring to FIG. 11, the downward movement (in vertical direction) of the tray 35 is regulated by the supporting section 37X (movement regulating second section) of the connective arm 37R, by the upstream portion of the tray 35, relative to the portion of the tray 35, which is supported by the connective arm holding sections 371L and 371R. Further, the leftward-rightward movement (direction Y) of the tray 35 is regulated by the tray holding tab 37C (movement regulating third section), which contacts the tray reinforcement plate 351R as if it bites the reinforcement plate 351R.

Referring also to FIG. 11, the outward movement (direction X) of the tray 35 is regulated by the pair of pins 372 attached to the arm holding components 371L and 371R, one for one (tray 35 is prevented from falling out of apparatus main assembly 100A), and so is the upward movement of the tray 35.

Referring again to FIG. 11, on the further downstream portion of the tray 35 relative to the portion of the tray 35, which is in contact with the door 31, the downward movement (in terms of vertical direction) of the tray 35 is regulated by the door 31.

Next, referring to part (a) of FIG. 12 which shows the relationship between the projection 37A of the connective arm 37 and the slot 311 of the door 31, in terms of their engagement, as a user opens the door 31, the projection 37A of the connective arm 37 slides along the edge of the slot 311 of the door 31. Eventually, the projection 37A comes into contact with the sections 311*a* and 311*c* of the edge of the slot 311, preventing the door 31 from further opening (rotating).

2) Case where User Applies Downward Force F1 to Downstream End of Tray 35

If a user happens to apply a downward force F1 (FIG. 11) to the downstream end of the tray 35 after the user pulled out the tray 35 from the apparatus main assembly 100A to replace a cartridge P (cartridges P), the force F1 works in the direction to pivotally rotate the tray 35 about the pair of tray retention pins 372. In this situation, the tray 35 is supported by the front end portion of the connective arm holding component 371R, by the bottom surface of the tray 35.

As described above, the connective arm 37R supports the tray 35 by the bottom surface of the tray 35. If the connective arm 37R is deformed downward by the load applied to the tray 35, the connective arm 37R is supported, from the underside, by the arm holding component 312, with which the door 31 is provided, and which is disposed with the provision of a small amount of clearance from the connective arm 37R. Thus, the rotational movement of the connective arm 37R is regulated, and therefore, the tray 35 is prevented from moving downward.

In the above-described situation, the applied force is caught at a position which is farther away in the direction X from the tray retention pin 372 (FIG. 11), which functions as the pivot for the tray, than connective arm holding section 371R. Therefore, the amount of force required to prevent the tray 35 from rotating further is smaller.

Further, the door 31 also is prevented from rotating further by the contact between the projection 37A of the connective arm 37R and the sections 311*a* and 311*c* of the edge of the slot 311 of the door 31. That is, the door 31 itself is locked in its wide-open position. Therefore, the door 31 can support the tray 35 from the underside of the tray 35. The door 31 can bear the load applied to the tray 35, at a position which is farther way in the direction X from the tray retention pin 372 (FIG. 11) than the connective arm 37R.

As described above, in the case of this structure, in a case where a load is applied downward (in terms of vertical direction) by a user, the load is borne at multiple components (multiple points), that is, not only by the connective arm holding section 371R, which is near the tray retention pin 372 (FIG. 11), which functions as the pivot of the door 31, but also, components and sections other than the connective arm holding section 371R. In other words, it is possible to prevent the force applied to the tray 35, from concentrating upon the upstream end portion of the tray 35 and/or the connective arm holding section 371R which supports the tray 35. Therefore, it is possible to prevent the problem that damages are caused by the downward force applied to the tray 35 by a user.

3) Case where Force is Applied Upward to Downstream End Portion of Tray 35 by User.

Moreover, this embodiment makes it possible to prevent the problem that as a user accidentally applies upward force F2 (FIG. 11) to the upstream end portion of the tray 35, where the handle 35*a* is, the tray 35 and/or components in the adjacencies of the tray 35 are damaged. More concretely, the rear end portion of the tray 35 is supported by the arm holding section 371R. Thus, if upward force F2 is accidentally applied to the tray 35, the force works in a manner to cause the tray 35 to rotate about the point of contact between the arm holding section 371R and tray 35. In this case, the tray 35 is protected from above, by the reinforcement plate 351R held to the tray 35 with the tray retention pin 372 (FIG. 11). Further, the tray reinforcement plate 351R is prevented from moving upward (in terms of vertical direction) by the tray regulating section 37B (10(*b*)) with which the connective arm 37R is provided.

In this case, the tray regulating section 37B can catch the force F2 at a point which is farther, in terms of the direction X, from the tray retention pin 372, which functions as the pivot for the rotation of the tray 35, than the connective arm holding section 371R. Therefore, it does not have to bear as much force as the amount of force which the connective arm holding section 371R has to, in order to prevent the tray 35 from being deformed.

Further, the leftward-rightward movement of the tray 35 relative to the connective arm 37R is regulated by the tray holding tab 37C. Therefore, it does not occur that the connective arm 37R is twisted by the load from the tray 35. Therefore, it does not occur that the tray regulating section 37B is made to fall out of the slot 311 of the door 31. Therefore, it is ensured that the upward movement (in terms of vertical direction) of the tray 35 is regulated by the tray regulating section 37B with which the connective arm 37R is provided.

As described above, in this embodiment, the image forming apparatus 100 is structured so that in a case where the tray 35 is accidentally subjected to the upward force F2 by a user, the upward force F2 can be borne not only by the connective arm holding section 371R to which the tray retention pin 372, which functions as the center of the tray rotation, is attached, but also, by the tray regulating section 37B. Therefore, it does not occur that the upward force F2 is concentrated to the rear end portion of the tray 35 and/or connective arm holding section 371 which supports the tray 35. Therefore, it is possible to prevent the problem that the rear end portion of the tray 35 and/or the connective arm holding section 371R is damaged by the accidentally applied upward force F2.

4) Case where Connective Arms 37 are Subjected to Upward Load

At this time, what occurs as the connective arm 37 is subjected to upward load is described in detail in terms of dynamics. Referring to part (a) of FIG. 12, as the projection 37A of the connective arm 37 is subjected to upward force (in terms of vertical direction), the projection 37A is pivotally moved in the direction indicated by an arrow mark R1, and comes into contact with the section 311*c* of the edge of the slot 311 of the door 31. Thus, the door 31 receives the force from the connective arm 37R. This force works in the direction, indicated by an arrow mark R2, to close the door 31.

The center of the rotation of the connective arm 37R is different from the center of rotation of the door 31. Thus, as the projection 37A is subjected to the upward force, the force works in the direction to cause the projection 37A to rotate away from the apparatus main assembly 100A as indicated by the arrow mark R2. However, the same force works in the direction to cause the section 311*b* of the edge of the slot 311 to rotate toward the apparatus main assembly 100A as indicated by the arrow mark R2.

The slot 311 of the door 31 is bent (dog-legged) as shown in part (a) of FIG. 12. Therefore, as the application of the above-described upward continues, the door 31 and the connective arm 37 are rotationally moved away from each other, eventually causing the section 311*b* of the edge of the slot 311 of the door 31 to come into contact with the connective projection 37A of the connective arm 37. That is, when the door 31 is wide open, the connective projection 37A remains in contact with the section 311*b* of the edge of the slot 311. In other words, the slot 311 is shaped so that as the door 31 is subjected to the upward force when it is wide open, the connective projection 37A is locked into the position in which it remains in contact with the section 311*b* of the edge of the slot 311.

In addition, the section 311*b* of the edge of the slot 311 is angled enough to prevent the connective projection 37A of the connective arm 37 from sliding down along the section 311*b*. Thus, the door 31 and connective arm 37R remain locked to each other, being therefore prevented from rotating. In other words, the upward movement of the tray 35 can be checked by the tray regulating section 37B.

Referring to part (b) of FIG. 12, what occurs as the door 31 is closed is as follows. The door 31 (slot 311) rotates in the direction R2, with the connective projection 37A of the connective arm 37 remaining stationary. During this movement of the door 31 (slot 311), there is a small amount of gap between the section 311*b* of the edge of the slot 311 of the door 31, and the connective projection 37A of the connective arm 37. Therefore, the connective projection 37A does not interfere with the movement of the door 31 (slot 311). Therefore, the connective projection 37A of the connective arm 37 comes out of the section of the slot 311, which has the section 311*b*, and comes into contact with the section 311*d* of the edge of the slot 311, allowing thereby the door 31 to be rotationally closed, as shown in part (b) of FIG. 12. That is, it does not occur that the door 31 hangs up while it is closed. Therefore, the door 31 smoothly closes along with the connective arms 37L and 37R.

In this embodiment, the door 31 does not directly support the tray 35. Instead, it is supported by the connective arm 37. However, the image forming apparatus 100 may be structured so that the tray 35 is directly supported by both the connective arm 37 and door 31. In such a case, the tray 35 is more firmly supported than in a case where it is by only one of the connective arm 37 and door 31 that the tray 35 is directly supported.

Embodiment 2

FIG. 13 is a schematic sectional view of the front end portion of the apparatus main assembly 100A and the tray 35 in the second embodiment, when the tray 35 is in its outermost position. It shows how the tray 35 is supported. FIG. 14 is a perspective view of a combination of the rear end portion of the tray 35 and the front end portion of the apparatus main assembly 100A, as seen from the side from which the cartridges P are driven, when the tray 35 is in its outermost position. FIG. 15 is a drawing for showing the movement of the connective arm 37, which occurs as the door 31 in the second embodiment is opened or closed. The differences between the first and second embodiments are as follows.

In the first embodiment, the guide 311 (slot) which guides the projection (boss) of the connective arm 37 belonged to the door 31. In the second embodiment, the guide 371S (guiding slot) by which the projection of the connective arm 37 is guided is a part of the guide 371 which belongs to the apparatus main assembly 100A. Thus, the second embodiment is different from the first embodiment in terms of the path of the connective arm 37R as a connective component. More concretely, the apparatus main assembly 100A is provided with a connective rod 201, which is in engagement with the connective arm 37R. The connective rod 201 connects or separates the driving force input section by being moved frontward or rearward by the opening or closing movements of the door 31, respectively. It is shaped so that its lengthwise direction is parallel to the vertical direction.

Part (a) of FIG. 15 shows the state of the rear end portion of the apparatus main assembly 100A when the door 31 remains closed. Part (b) of FIG. 15 shows the state of the rear end portion of the image forming apparatus 100 when the door 31 is half open. As the door 31 is rotationally moved, the connective arm 37R rotates with the door 31 about a boss 37D (FIG. 14) fitted in the hole of the connective arm supporting section 31A attached to the door 31. Thus, as the door 31 is opened, the connective projection 37A (FIG. 14) is made to move downward by the movement of the door 31, sliding along the edge of the slot 371S of the guide 371. Further, the connective rod 201 (FIG. 14), which has a slot 201A, in which the boss of the connective arm 37R is fitted, is pulled out frontward.

Part (c) of FIG. 15 shows the rear end portion of the apparatus main assembly 100A when the door 31 is fully open. The connective arm 37R has rotated with the door 31. The connective projection 37A has moved into the bent portion 371T of the slot 371S, which is the bottom end portion of the slot 371S, being locked in the bent portion 371T. Thus, the door 31 is prevented from rotating further. FIG. 13 is a schematic sectional view of the front end portion of the image forming apparatus 100 when the door 31 is in the state shown in part (c) of FIG. 15, and the tray 35 is in its outermost position.

The rear end portion of the tray 35 is supported by the connective arm holding section 371R. Thus, if force is applied to the tray 35 by a user in the direction indicated by an arrow mark F2 in FIG. 13, the force works in the direction to rotate the tray 35 about the point of contact between the front end of the connective arm holding section 371R and the tray 35. However, the tray retention pin 372 prevents (from top side of tray reinforcement plate 351R) the tray 35 from being rotated about the point of contact by the force applied by the user, as in the first embodiment. Also, the tray regulating section 37B of the connective arm 37R prevents (from top side of reinforcement plate 351R) the tray 35 from being rotated by the applied force.

Moreover, as the connective arm 37R is subjected to upward force while the rear end portion of the image forming apparatus 100 is in the state shown in part (c) of FIG. 15, the connective projection 37A comes into contact with the edge of the bent section 371T (part (a) of FIG. 15) of the slot 371S (guiding section). Thus, the tray 35 is not allowed to rotate. Therefore, the connective arm 37R can withstand the upward force which it receives from the tray 35.

As described above, with the employment of the structural arrangement in this embodiment, even if a substantial amount of force is accidentally applied to the tray 35 by a user, the force is not concentrated to the rear end portion of the tray 35.

Referring to FIG. 16, some conventional image forming apparatuses are structured so that when their tray 35 is in its outermost position, the rear end portion of the tray 35 is on the inward side of the end of the side plate of the rigid main frame. Therefore, the rear end portion of the tray 35 is firmly held by the rigid side plate of the main frame, and the components in the adjacencies of the side plate. On the other hand, these conventional image forming apparatuses are structured so that their top side is opened for the installation or uninstallation of cartridges. Further, they are structured so that their front door is to be opened to expose the opening. Therefore, their front door is rather large, and complex in structure.

In comparison, the image forming apparatuses in the preceding embodiments of the present invention are structured so that what is relied upon to bear load when a substantial mount of force is accidentally applied to the tray 35 by a user, it is not the rigidity, alone, of the components which support the tray 35. Therefore, it is unnecessary for an image forming apparatus to be structured so that when the tray 35 is in its outermost position, the rear end portion of the tray 35 remains on the inward side of the side plate. That is, in the case of the image forming apparatuses in the preceding embodiments, the tray 35 can be farther pulled out of the main assembly of the apparatus relative to the side plate of the apparatus, than any conventional image forming apparatus. Therefore, they are superior in usability than any conventionally structured image forming apparatuses. Moreover, an image forming apparatus can be reduced in the size of its side plates, simplified in tray structure, reduced in the size of the components which are present in the adjacencies of the tray to support the tray, and can be reduced in size and simplified. In other words, the present invention can reduce an image forming apparatus in size, weight, and cost.

(Modified Versions)

In the foregoing, a few preferred embodiments of the present invention were described. However, these embodiments are not intended to limit the present invention in scope. That is, the present invention is also applicable to various modified versions of the image forming apparatuses in the preceding embodiments, within the range of the gist of the present invention.

(Modification 1)

Regarding a cartridge such as the above-described cartridge P, the application of the present invention is not limited to a process cartridge of the so-called integration type, that is, a process cartridge having: an image bearing component 1 on which a latent image is formed; and a developing means 3 which develops a latent image formed on the image bearing component, with the use of developer. For example, the present invention is also applicable to a process cartridge of the so-called separation type, that is, a process cartridge having: an image bearing component 1 on which a latent image is formed; and a cartridge having processing means other than a developing means which develops the latent image formed on the image bearing component 1, with the use of developer.

Further, the present invention is applicable to a development cartridge having a developing means for developing a latent image formed on an image bearing component 1, with the use of developer; and a developer storing section which contains the developer to be used for developing the latent image.

Moreover, the present invention is applicable to an image forming apparatus which uses cartridges, each of which is a combination of a process cartridge of the so-called separation type and a development cartridge, and is structured so that at least one of the process cartridge of the separation type and development cartridge is removably mounted in the tray 35. The cartridges which are installable in this type of image forming apparatus each include a unit which is removably installable in the main assembly of the apparatus and contributes to the process for forming an image on recording medium.

(Modification 2)

Regarding the connective arms 37L and 37R, as a connective component, which connects the door and main assembly of an image forming apparatus, in the preceding embodiments, the door or apparatus main assembly was provided with slots, whereas the connective arms 37L and 37R were provided with a projection which fits in the slot. However, the preceding embodiments are not intended to limit the present invention in scope. For example, the present invention is also applicable to an image forming apparatus structured so that the door or apparatus main assembly is provided with a pair of projections, whereas the connective arms 37L and 37R are provided with a pair of slots, in which the projections fit one for one.

(Modification 3)

In the above-described embodiments, the apparatus main assembly was provided with the pair of connective arm holding sections 371L and 371R which holds the connective arms, on the outward side of the apparatus main assembly, and was structured so that these holding sections 371L and 371R prevent the tray from moving vertically downward. However, the present invention is also applicable to an image forming apparatus structured so that the holding sections 371L and 371R prevent the tray from moving vertically downward.

(Modification 4)

In the above-described embodiments, the image forming apparatus was structured so that the tray is horizontally pulled out of the apparatus main assembly. However, the present invention is also applicable to an image forming apparatus structured so that the tray is pulled out of the apparatus main assembly at a preset angle, or the angle at which the tray is pulled out of the apparatus main assembly changes while the tray is pulled out.

(Modification 5)

Further, in the above-described embodiments, each cartridge was of the so-called integration type, and was a combination of a photosensitive component unit and a development unit. However, the present invention is also applicable to an image forming apparatus, the photosensitive component unit and tray of which are integrated, and is structured so that only a development unit can be replaced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-106959 filed on May 27, 2015, which is hereby incorporated by reference herein in its entirety.

What is claimed is:

1. An image forming apparatus comprising:

a main assembly provided with an opening;

a supporting member configured to dismountably support a cartridge configured to form an image on a recording material, said supporting member being movable between an inside position, which is inside said main assembly, and an outside position, which is outside said main assembly, through said opening;

an openable member configured to open and close said opening; and a connecting member configured to connect said openable member and said main assembly with each other, and configured be rotatable with respect to said openable member and said main assembly, said connecting member being provided with a movement regulating portion configured to regulate movement of said supporting member placed in the outside position in a state in which said openable member opens said opening, wherein said connecting member is provided with one of (i) a projection engaged with a groove of one of said openable member and said main assembly, and (ii) a groove engaged with a projection of one of said openable member and said main assembly, wherein by movement of said projection in said groove during one of an opening operation and a closing operation of said openable member, said connecting member is moved in interrelation with the one of the opening operation and the closing operation of said openable member, and wherein, in a state in which said openable member is open, said projection is in a recess provided at an end portion of said groove, and said recess is configured such that said projection is locked with said groove upon a movement in a direction including an upward component.

2. An apparatus according to claim 1, wherein when said openable member is moved in a direction to close said opening, said projection is disengaged from said recess.

3. An apparatus according to claim 1, wherein said movement regulating portion includes an upward movement regulating portion configured to regulate an upward movement of said supporting member in the outside position.

4. An apparatus according to claim 1, wherein said movement regulating portion includes a downward movement regulating portion configured to regulate a downward movement of said supporting member in the outside position.

5. An apparatus according to claim 4, wherein said movement regulating portion includes an upward movement regulating portion configured to regulate an upward movement of said supporting member, and wherein said downward regulating portion is disposed downstream of said upward regulating portion with respect to a moving direction of said supporting member from the inside position to the outside position.

6. An apparatus according to claim 1, wherein said movement regulating portion includes a longitudinal movement regulating portion configured to regulate movement of said supporting member in a longitudinal direction of the cartridge supported by said supporting member in the outside position.

7. An apparatus according to claim 1, wherein said main assembly includes a movement regulating portion for regulating a position of said supporting member with respect to a moving direction between the inside position and the outside position, in the outside position.

8. An apparatus according to claim 1, wherein, when said supporting member is moved to the outside position, a rear end of said supporting member is downstream of a frame of said main assembly with respect to a moving direction of said supporting member.

9. An apparatus according to claim 1, wherein when said supporting member is moved to the outside position, said openable member supports said supporting member at a lower side.

10. An apparatus according to claim 1, wherein said main assembly includes a holding portion configured to hold said connecting member at a position outside of said main assembly, and wherein said holding portion regulates downward or upward movement of said supporting member.

11. An image forming apparatus comprising:

a main assembly provided with an opening;

a supporting member configured to dismountably support a cartridge configured to form an image on a recording material, said supporting member being movable between an inside position, which is inside said main assembly, and an outside position, which is outside said main assembly, through said opening;

an openable member configured to open and close said opening; and a connecting member configured to connect said openable member and said main assembly with each other, and configured to be rotatable with respect to said openable member and said main assembly, said connecting member being provided with a movement regulating portion configured to regulate movement of said supporting member placed in the outside position in a state in which said openable member opens said opening, wherein said movement regulating portion includes an upward movement regulating portion configured to regulate an upward movement of said supporting member in the outside position.

12. An apparatus according to claim 11, wherein said movement regulating portion includes a downward movement regulating portion configured to regulate a downward movement of said supporting member in the outside position.

13. An apparatus according to claim 12, wherein said downward regulating portion is disposed downstream of said upward regulating portion with respect to a moving direction of said supporting member from the inside position to the outside position.

14. An apparatus according to claim 11, wherein said movement regulating portion includes a longitudinal movement regulating portion configured to regulate movement of said supporting member in a longitudinal direction of the cartridge supported by said supporting member in the outside position.

15. An apparatus according to claim 11, wherein said main assembly includes a movement regulating portion for regulating a position of said supporting member with respect to a moving direction between the inside position and the outside position, in the outside position.

16. An apparatus according to claim 11, wherein, when said supporting member is moved to the outside position, a rear end of said supporting member is downstream of a frame of said main assembly with respect to a moving direction of said supporting member.

17. An apparatus according to claim 11, wherein when said supporting member is moved to the outside position, said openable member supports said supporting member at a lower side.

18. An apparatus according to claim 11, wherein said main assembly includes a holding portion configured to hold said connecting member at a position outside of said main assembly, and wherein said holding portion regulates downward or upward movement of said supporting member.

19. An image forming apparatus comprising:

a main assembly provided with an opening;

a supporting member configured to dismountably support a cartridge configured to form an image on a recording material, said supporting member being movable between an inside position, which is inside said main assembly, and an outside position, which is outside said main assembly, through said opening;

an openable member configured to open and close said opening; and a connecting member configured to connect said openable member and said main assembly with each other, and configured to be rotatable with respect to said openable member and said main assembly, said connecting member being provided with a movement regulating portion configured to regulate movement of said supporting member placed in the outside position in a state in which said openable member opens said opening, wherein said movement regulating portion includes a longitudinal movement regulating portion configured to regulate movement of said supporting member in a longitudinal direction of the cartridge supported by said supporting member in the outside position.

20. An apparatus according to claim 19, wherein said movement regulating portion includes a downward movement regulating portion configured to regulate a downward movement of said supporting member in the outside position.

21. An apparatus according to claim 20, wherein said movement regulating portion includes an upward movement regulating portion configured to regulate an upward movement of said supporting member, wherein said downward regulating portion is disposed downstream of said upward regulating portion with respect to a moving direction of said supporting member from the inside position to the outside position.

22. An apparatus according to claim 19, wherein said main assembly includes a movement regulating portion for regulating a position of said supporting member with respect to a moving direction between the inside position and the outside position, in the outside position.

23. An apparatus according to claim 19, wherein, when said supporting member is moved to the outside position, a rear end of said supporting member is downstream of a frame of said main assembly with respect to a moving direction of said supporting member.

24. An apparatus according to claim 19, wherein when said supporting member is moved to the outside position, said openable member supports said supporting member at a lower side.

25. An apparatus according to claim 19, wherein said main assembly includes a holding portion configured to hold said connecting member at a position outside of said main assembly, and wherein said holding portion regulates downward or upward movement of said supporting member.

* * * * *